US011378331B2

(12) United States Patent
Kim et al.

(10) Patent No.: US 11,378,331 B2
(45) Date of Patent: Jul. 5, 2022

(54) REFRIGERATOR AND OUT PLATE FOR REFRIGERATOR DOOR

(71) Applicant: LG Electronics Inc., Seoul (KR)

(72) Inventors: Youngwoo Kim, Seoul (KR); Chijung Kim, Seoul (KR); Pojin Kim, Seoul (KR); Hyesun Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 742 days.

(21) Appl. No.: 16/212,022

(22) Filed: Dec. 6, 2018

(65) Prior Publication Data

US 2019/0170434 A1 Jun. 6, 2019

(30) Foreign Application Priority Data

Dec. 6, 2017 (KR) ..... 10-2017-0166446

(51) Int. Cl.
*F25D 29/00* (2006.01)
*F25D 23/02* (2006.01)
(Continued)

(52) U.S. Cl.
CPC ..... *F25D 29/005* (2013.01); *F21V 11/00* (2013.01); *F25D 23/028* (2013.01);
(Continued)

(58) Field of Classification Search
CPC .... F25D 2400/361; F25D 23/02; F25D 27/00; F25D 2400/36; F25D 2323/023; F25D 2327/001
See application file for complete search history.

(56) References Cited

U.S. PATENT DOCUMENTS 8,567,885 B2 * 10/2013 Lee ..... E05D 7/1044 312/405
10,330,380 B2 6/2019 Park
(Continued)

FOREIGN PATENT DOCUMENTS

AU 2014251552 8/2015
CN 201653932 11/2010
(Continued)

OTHER PUBLICATIONS

Extended European Search Report in European Application No. 18210133.7, dated Apr. 5, 2019, 5 pages.
(Continued)

*Primary Examiner* — William J Carter
(74) *Attorney, Agent, or Firm* — Fish & Richardson P.C.

(57) ABSTRACT

A refrigerator includes a cabinet, a door, an out plate that defines a front surface of the door, a display part at the out plate that defines plate holes configured to display operation information of the refrigerator by transmission of light through the out plate, light emitting members in the door at positions corresponding to the plate holes, hole filling members that fill the plate holes, and a first layer located at a surface of the hole filling members. The first layer includes a light blocking part, and light transmission parts positioned in an inner region of the plate holes. The display part is configured to transmit light having passed through one or more of the light transmission parts corresponding to one or more of the light emitting members.

20 Claims, 16 Drawing Sheets

(51) Int. Cl.
*F21V 11/00* (2015.01)
*F21Y 115/10* (2016.01)

(52) U.S. Cl.
CPC ..... *F21Y 2115/10* (2016.08); *F25D 23/02* (2013.01); *F25D 2400/361* (2013.01)

(56) References Cited

U.S. PATENT DOCUMENTS

| | | | | |
|---|---|---|---|---|
| 10,345,981 | B2 | 7/2019 | Kim et al. | |
| 10,520,243 | B2 | 12/2019 | Kim et al. | |
| 2014/0300263 | A1* | 10/2014 | Sung | F25D 23/028 312/404 |
| 2015/0192352 | A1* | 7/2015 | Sung | F25D 23/028 62/125 |
| 2016/0003519 | A1 | 1/2016 | Kim et al. | |
| 2016/0124565 | A1 | 5/2016 | Kim | |
| 2016/0186985 | A1 | 6/2016 | Kim et al. | |
| 2018/0231236 | A1 | 8/2018 | Kim et al. | |
| 2018/0274848 | A1 | 9/2018 | Kim et al. | |

FOREIGN PATENT DOCUMENTS

| | | |
|---|---|---|
| CN | 202106705 | 1/2012 |
| CN | 202727424 | 2/2013 |
| CN | 104339962 | 2/2015 |
| CN | 105051474 | 11/2015 |
| CN | 105358643 | 2/2016 |
| CN | 105546930 | 5/2016 |
| CN | 105737488 | 7/2016 |
| CN | 106461316 | 2/2017 |
| CN | 106996674 | 8/2017 |
| CN | 107062776 | 8/2017 |
| DE | 102014212396 | 12/2015 |
| EP | 2789943 | 10/2014 |
| EP | 3018438 | 5/2016 |
| EP | 3490184 | 5/2019 |
| EP | 3678317 | 7/2020 |
| KR | I00634365 | 10/2006 |
| KR | 10-2014-0121753 | 10/2014 |
| KR | 1020170048288 | 5/2017 |
| WO | WO2016072802 | 5/2016 |
| WO | WO2017052110 | 3/2017 |
| WO | WO2018016907 | 1/2018 |
| WO | WO2019023451 | 1/2019 |

OTHER PUBLICATIONS

India Office Action in India Application No. 201814045650, dated Jun. 24, 2020, 7 pages (with English translation).

Australian Office Action in Australian Application No. 2018274951, dated Jul. 5, 2019, 5 pages.

Extended European Search Report in European Appln. No. 19800573.8, dated Sep. 10, 2020, 10 pages.

Samsung, "On Search Space Design," R1-1717642, 3GPP TSG RAN WG1 Meeting 90bis, Prague, CZ, Oct. 9-13, 2017, 8 pages.

Office Action in Chinese Appln. No. 201811391122.2, dated Aug. 27, 2020, 16 pages (with English translation).

* cited by examiner

REFRIGERATOR AND OUT PLATE FOR REFRIGERATOR DOOR

CROSS-REFERENCE TO RELATED APPLICATIONS

The present application claims priority under 35 U.S.C. 119 and 35 U.S.C. 365 to Korean Patent Application No. 10-2017-0166446, filed on Dec. 6, 2017, which is hereby incorporated by reference in its entirety.

FIELD

The present disclosure relates to a refrigerator and to an out plate for a refrigerator door.

BACKGROUND

Refrigerators are home appliances that can store food items at a low temperature in a storage space, which may be covered by a door. In some examples, the refrigerators may cool the inside of the storage space using cool air generated by heat-exchanging with a refrigerant circulated through a refrigeration cycle to store food items in an optimum state.

In some cases, refrigerators may have various functions according to changes of diets and gentrification of products. For example, refrigerators may have various structures and convenience devices that provide convenience of users and efficient use of internal spaces.

In some examples, a refrigerator may include a display disposed on a door of the refrigerator for displaying operation states of the refrigerator In some cases, the display may display various pieces of information according to operation of the refrigerator in the form of figures, characters, symbols, or pictures.

In some cases, a user may check information outputted through a display assembly to determine the operation state of the refrigerator and perform manipulation for the operation of the refrigerator.

In one example, a refrigerator may include a display unit disposed on a rear surface of a front plate of a refrigerator door in which the front plate may be made of a metal material. In this example, a display part of the display unit may be visible by a user through a plurality of through-holes defined in the front plate. Each of the through-hole may have a uniform and minute size so that when an accurate character or shape can be displayed to improve readability the display unit operates. In some cases, an outer appearance of the character or shape may be displayed luxuriously based on the through-holes.

The plurality of through-holes may be defined by etching for a fine and uniform appearance. In some cases, a plurality of etching processes may be performed to uniformly and finely define the through-holes. In some cases, if it is not satisfied after inspection, the through-holes may be defined again by repeating the etching or by performing the etching three to four, or more times.

In some cases, the repetitive etching process may increase the manufacturing cost. In some cases, it may be difficult to define the through-holes uniformly to a target size based on the repeated etching process.

SUMMARY

The present disclosure provides a refrigerator, in which shapes of fine through-holes are uniformly realized to improve visibility and readability when viewed from the outside, and an out plate for a refrigerator door.

The present disclosure also provides a refrigerator, in which shapes of fine holes are uniformly realized without a repetitive etching operation, and an out plate for a refrigerator door.

The present disclosure further provides a refrigerator, which may reduce or prevent deformation due to a repetitive touch operation while realizing formation of a plurality of fine holes, and an out plate for a refrigerator door.

According to one aspect of the subject matter described in this application, a refrigerator includes a cabinet that defines a storage space, a door configured to open and close at least a portion of the storage space, an out plate that is made of a metal material and that defines a front surface of the door, a display part located at the out plate and configured to display operation information of the refrigerator by transmission of light, where the display part defines a plurality of plate holes that pass through the out plate, a plurality of light emitting members located in the door and configured to emit light at positions corresponding to the plurality of plate holes, a plurality of hole filling members that fill the plurality of plate holes, the plurality of hole filling members being made of a material configured to transmit light, and a first layer located at a surface of the plurality of hole filling members. The first layer includes a light blocking part configured to block light, and a plurality of light transmission parts positioned in an inner region of the plurality of plate holes and configured to transmit light. The display part is configured to transmit light that has been emitted from one or more of the plurality of light emitting members and that has passed through one or more of the plurality of light transmission parts corresponding to the one or more of the plurality of light emitting members.

Implementations according to this aspect may include one or more of the following features. For example, the display part may be further configured to display a figure, a character, or a pattern based on transmission of light through one or more of the plurality of plate holes. In some examples, the plurality of plate holes may define one or more multi-segment displays, where each multi-segment display includes a plurality of segments that are configured to indicate a figure, a character, a pattern, or a number.

In some implementations, the plurality of light transmission parts may be arranged at each of the plurality of plate holes along a plane, where a length of each of the plurality of light transmission parts along the plane is less than an opening size of each of the plurality of plate holes at the plane. In some implementations, the refrigerator may further include a touch sensor assembly that is located at the door at a position spaced apart from the display part, that contacts the out plate, and that is configured to detect touch manipulation at the out plate.

According to another aspect, an out plate for a refrigerator door includes a steel plate made of a metal, where the steel plate defines a plurality of plate holes that pass through the steel plate and that are configured to display a figure, a character, or a pattern, a plurality of hole filling members that fill the plurality of plate holes, where the plurality of hole filling members are made of a material configured to transmit light, a first layer located at a surface of the plurality of hole filling members. The first layer includes a light blocking part configured to block light, and a plurality of light transmission parts positioned in an inner region of the plurality of plate holes and configured to transmit light emitted from a plurality of light emitting members. The plurality of plate holes are configured to display the figure, the character, or the pattern by transmitting light that has been emitted from one or more of the plurality of light emitting members located at positions corresponding to the plurality of plate holes and that has passed through one or more of the plurality of light transmission parts.

Implementations according to this aspect may include one or more of the following features. For example, a size of each of the plurality of light transmission parts may be greater than or equal to 100 micrometers and less than 1 millimeter. In some examples, the steel plate may include a stainless steel plate or a vinyl coated material (VCM) steel plate.

In some implementations, the out plate may further include a second layer that is located at a front surface of the steel plate, that is configured to transmit light, and that provides a color of the refrigerator door or a texture of the refrigerator door. In some examples, the out plate may further include a third layer located between the second layer and the steel plate and configured to provide a metal texture of the refrigerator door. In some examples, the out plate may further include a fourth layer located between the second layer and the steel plate and configured to structurally reinforce a strength of at least a portion of the steel plate, where the fourth layer may be made of a material configured to transmit light.

In some implementations, the first layer may be located between the second layer and the steel plate. In some cases, the plurality of plate holes may be defined by etching, and the light blocking part may be printed on a surface of the first layer at an area outside of the plurality of light transmission parts. In some examples, the out plate may further include an attachment guide part defined at the steel plate and configured to guide alignment of the plurality of light transmission parts to the plurality of plate holes based on the first layer being attached to the steel plate.

In some implementations, an inner side surface of each of the plurality of plate holes may have an inclined shape or a round shape. In some implementations, the out plate may further include a back coating layer located at a rear surface of the steel plate and configured to reduce corrosion of the steel plate and a chemical damage of the steel plate.

In some implementations, the first layer may be made of a polyethylene terephthalate (PET) film material, where the light blocking part and the plurality of light transmission parts are manufactured by a printing process. The first layer may be attached to the steel plate based on the first layer including the light blocking part and the plurality of light transmission parts manufactured by the printing process.

In some implementations, the first layer may be located at a front surface of the steel plate. In some examples, the light blocking part and the plurality of light transmission parts may be located at a surface of the first layer that contacts the plurality of hole filling members. In some examples, the first layer may be made of a material configured to block light and located at a rear surface of the steel plate, and each of the plurality of light transmission parts may have a hole shape that passes through the first layer.

The details of one or more implementations are set forth in the accompanying drawings and the description below. Other features will be apparent from the description and drawings, and from the claims.

BRIEF DESCRIPTION OF THE DRAWINGS

FIG. 8B is a view illustrating an example display part that is turned on.

DETAILED DESCRIPTION

Hereinafter, detailed implementations of the present disclosure will be described in detail with reference to the accompanying drawings. However, the scope of the present disclosure is not limited to proposed implementations, and other regressive disclosures or other implementations included in the scope of the spirits of the present disclosure may be easily proposed through addition, change, deletion, and the like of other elements.

Particularly, the implementations will be described by way of example in which a display part is provided on a door of a refrigerating compartment on one side of a pair of refrigerating compartment doors provided in a bottom freeze type refrigerator for convenience of explanation and understanding. It is to be noted that the present disclosure may be applicable to any types of refrigerators configured to include a display portion.

Figure 1:
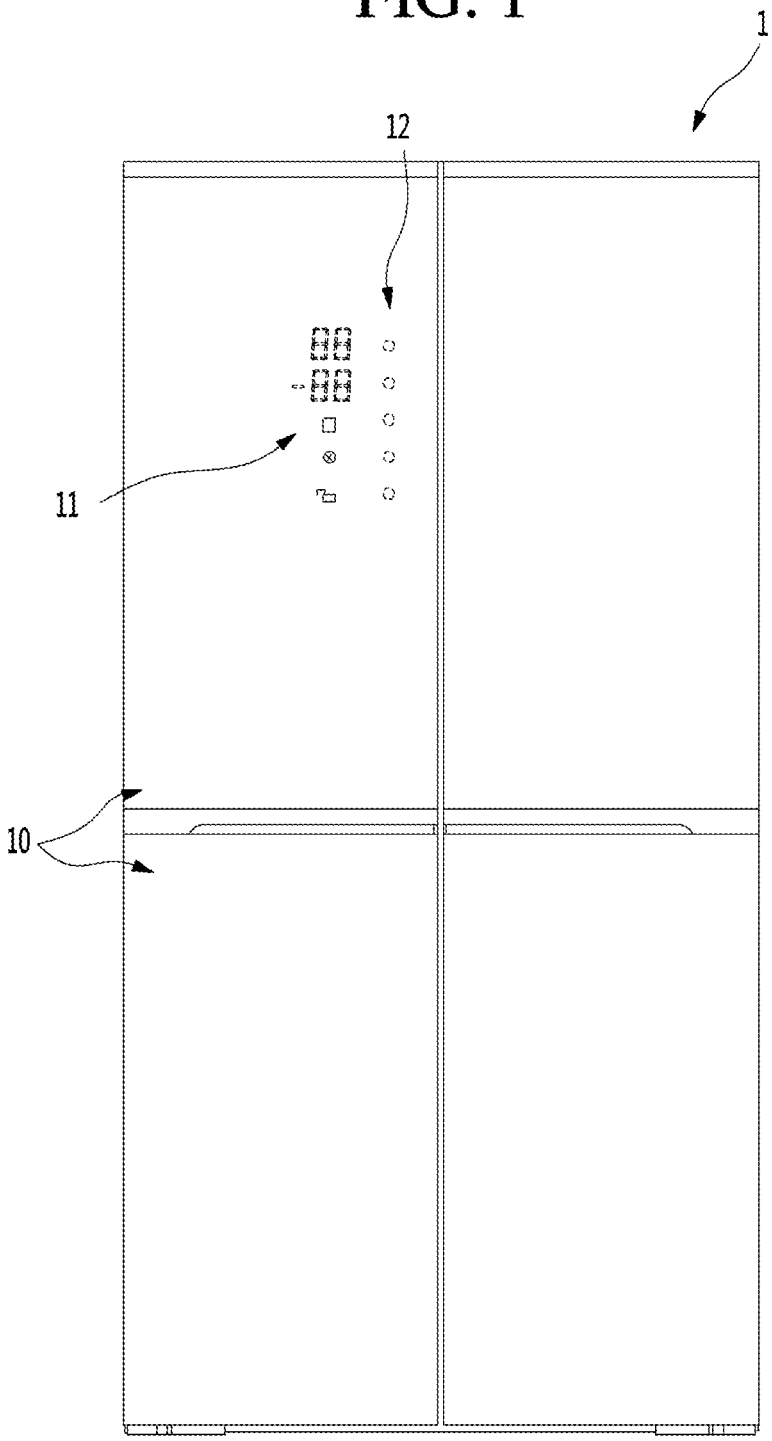
FIG. 1 is a front view illustrating an example refrigerator according to a first implementation.

FIG. 1 is a front view of an example refrigerator according to a first implementation.

Referring to FIG. 1, a refrigerator 1 includes a cabinet defining a storage space and a door 10 mounted on a front surface of the cabinet to open or close the storage space. Here, an outer appearance of the refrigerator 1 may be defined by the cabinet and the door 10.

In some implementations, the storage space may be partitioned into both left/right sides or vertically partitioned. A plurality of doors 10 for opening/closing the spaces may be disposed on the opened spaces of the storage space. The doors 10 may open and close the storage space in a sliding or rotating manner. In a state in which the door 10 is closed, the door 10 may define a front outer appearance of the refrigerator 1.

In some examples, a display part 11 and a manipulation part 12 may be disposed on one door 10 of the plurality of doors 10 at a height at which user's manipulation and distinguishment are easy.

The display part 11 may be configured to display an operation state of the refrigerator 1 to the outside. A symbol or figure may be expressed while light emitted from the inside of the door 10 passes through the display part 11 to allow a user to identify the operation information.

In some examples, if light is not emitted from the inside of the door 10, the light may not be emitted through the display part 11 to the outside. Thus, when viewed from the outside, the display part 11 may not be visible. In some examples, if light is not emitted from the inside of the door 10, an outer appearance may be realized as if a constituent for display information such as the display part 11 is not provided on the door 10.

The manipulation part 12 may be a portion for inputting manipulation for an operation of the refrigerator by the user and be provided on a portion of the front surface of the door 10. Here, the manipulation part 12 may be disposed at a position that is parallel or adjacent to the display part 11.

The manipulation part 12 may be disposed so that a portion at which a pressing operation is detected is printed or is visible to the user through surface processing such as etching. In some examples, a touch sensor assembly 80 may be provided inside the door 10 to correspond to the manipulation part 12 so that the user's pressing operation on the manipulation part 12 is detected.

The manipulation part 12 may not be provided on the door on which the display part 11 is disposed but be provided on the other door 10 of the plurality of doors 10 or may be provided on one side of the cabinet, but on the door 10. In some examples, as necessary, the manipulation part 12 may be configured to operate by a switch or a button rather than touch.

In some examples, the manipulation part 12 may not be visible from the outside like the display part 11 when the light is not emitted from the inside of the door 10. Thus, all the display part 11 and the manipulation part 12 may not be visible from the outside.

Figure 2:
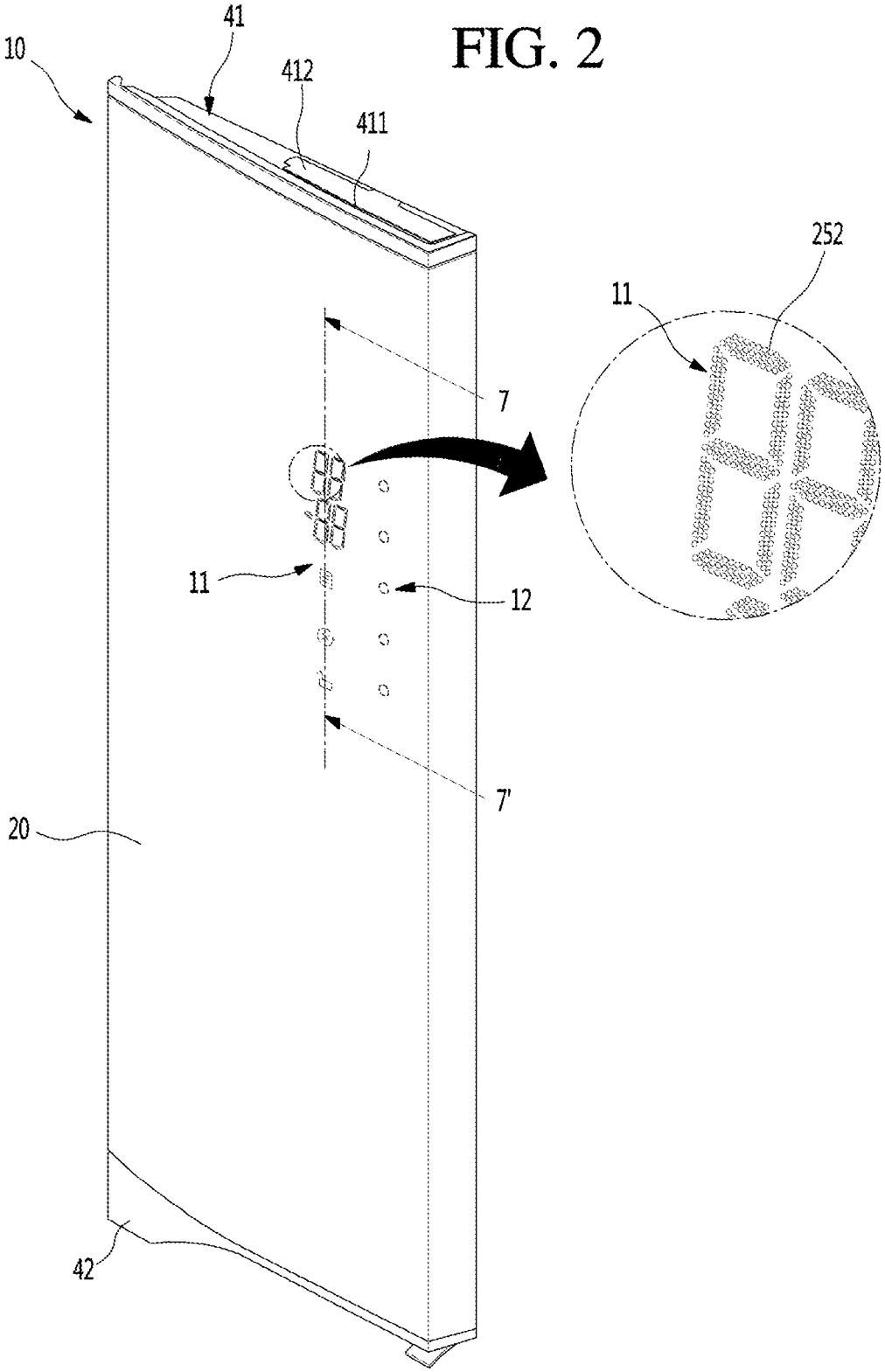
FIG. 2 is a perspective view illustrating an example refrigerator door according to the first implementation.
Figure 3:
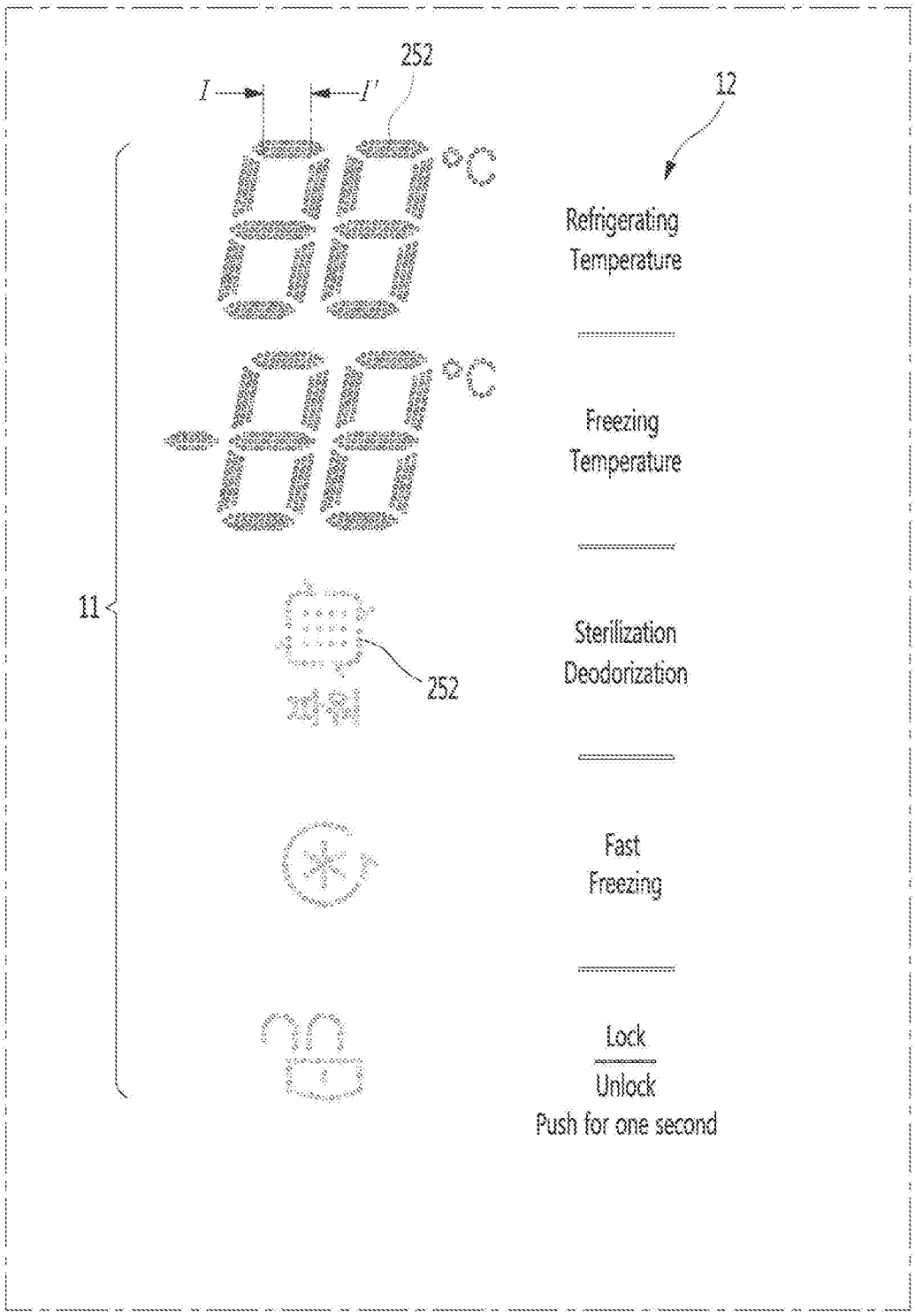
FIG. 3 is an enlarged view illustrating an example display part that is disposed on a front surface of the refrigerator door and that is configured to be turned on and off.

FIG. 2 is a perspective view illustrating an example refrigerator door according to the first implementation. FIG. 3 is an enlarged view illustrating the display part that is disposed on the front surface of the refrigerator door that is configured to be turned on and off.

As illustrated in the drawings, the entire outer appearance of the door 10 may be defined by coupling an out plate defining an outer appearance of the front surface, a door liner 30 defining an outer appearance of a rear surface, and cap decors 41 and 42 provided on upper and lower ends of the door 10.

In more details, the out plate 20 may define the outer appearance of the front surface of the door 10 and be made of a plate-shaped metal material. The out plate 20 may be provided as a color steel plate to realize texture such as stainless steel plate or stainless steel.

The out plate 20 may be bent to be provided on a portion of a circumferential surface of the door 10 in addition to the front surface of the door 10. In some examples, the out plate 20 may have a predetermined curvature so that the front surface of the door 10 has a rounded shape. In some examples, anti-fingerprint processing may be performed on the out plate 20, or a specific color, pattern, and design may be expressed on the out plate 20. Alternatively, a hairline may be formed on the out plate 20 to realize metal texture.

The display part 11 may be visible by the plurality of light transmission parts 252 provided in a portion of an area of the out plate 20. The display part 11 may be provided as an assembly of the plurality of light transmission parts 252 that are continuously disposed in a predetermined arrangement to indicate figures or symbols. For example, the plurality of light transmission parts 252 may be arranged in a seven segment shape and also be arranged to indicate a specific symbol, pattern, or character that is capable of indicating a state of the refrigerator 1.

The light transmission part 252 is disposed to correspond to an arrangement of a plurality of through-holes 62 and 73 that will be described below so that light emitted from the light emitting member 74 of the display assembly 70 passes through the light transmission part 252. The light emitting member 74 may be a light emitting diode (LED).

Light may be irradiated to pass through a portion of the light transmission parts 252 disposed at a position corresponding to the position of the light emitting member 74 to which the light is irradiated, and the light transmission parts 252 to which the light is irradiated may display a specific number, a character, or the like to transmit information to the user as illustrated in FIG. 2.

That is, when at least a portion of the light emitting members 74 is turned on, the light transmission parts 252 of the plurality of light transmission parts, which corresponds to the light emitting member 74 that is turned on may be exposed to the outside while the light passes through the light transmission parts 252. Here, the exposed light transmission parts 252 may be combined with each other to display a specific figures (for example, 4 or −12 as illustrated in FIG. 3) or display characters or pictures to transmit information to the user.

On the other hand, the light transmission part 252 disposed at a position that does not correspond to the position of the light emitting member 74, to which the light is irradiated, of the light emitting members 74 may not transmit light and thus may not be visible from the outside.

Although the plurality of light transmission parts 252 are illustrated in FIG. 2, the light transmission parts 252 may not be substantially well visible when the user is located at a position that is away somewhat from the door 10 in the state in which the light transmission parts 252 are turned on.

In some examples, the manipulation part 12 may be disposed on a side of the display part 11. The manipulation part 12 may simply display only the manipulated position so that the user recognizes the manipulation part 12 or display a manipulation function in the form of the characters as illustrated in FIG. 3. In some examples, the manipulation state may be displayed on the display part 11 according to the manipulation of the manipulation part 12.

Figure 4:
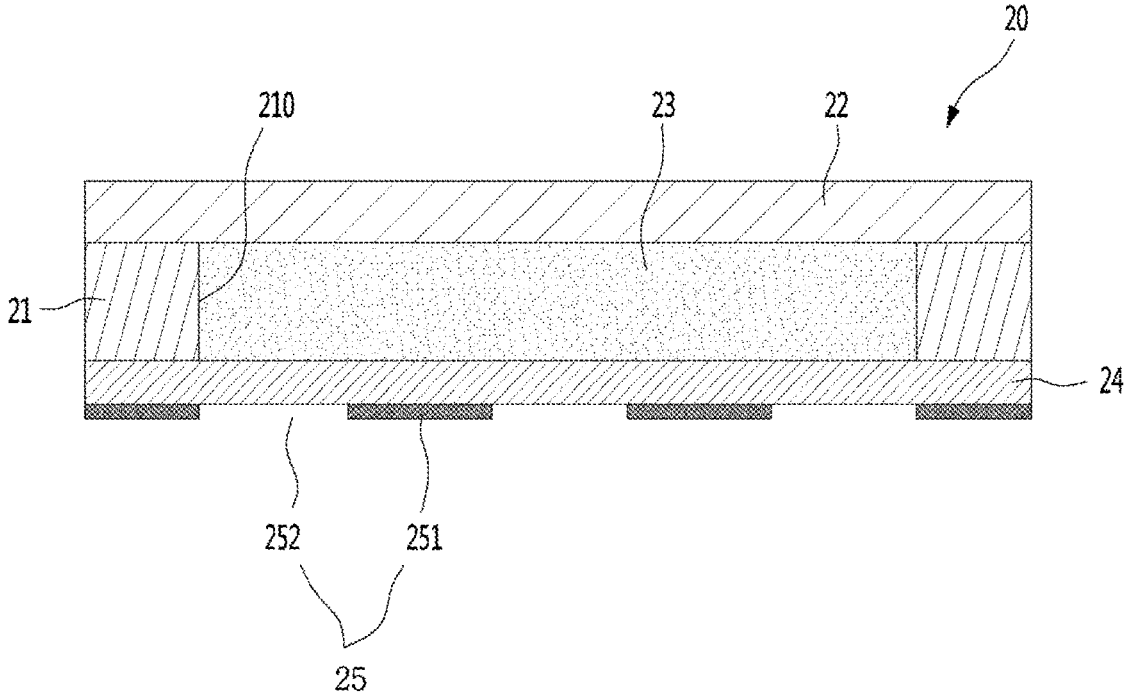
FIG. 4 is a cross-sectional view illustrating the display part taken along line I-I' of FIG. 3.

Hereinafter, the out plate will be described in more detail with reference to the accompanying drawings. In FIG. 4, for convenience of explanation and understanding, the outside of the door is referred to as a top surface or a front surface, and the inside of the door is referred to as a bottom surface or a rear surface.

FIG. 4 is a cross-sectional view illustrating the display part taken along line I-I' of FIG. 3.

As illustrated in FIG. 4, since the out plate 20 defines the outer appearance of the door 10, the out plate 20 may have a thickness at which sufficient strength is secured. In some examples, the out plate 20 may include a steel plate 21 that maintains strength and defines the whole shape. The steel plate 21 may be a stainless steel plate.

In some examples, a coating layer 22 may be disposed on a top surface of the steel plate. The coating layer 22 forms a surface of the out plate 20 and may include coating for forming an inner fingerprint or a color and coating for forming surface texture of the out plate. The coating layer 22 may include one or more layers.

The steel plate 21 may be a VCM or PCM steel sheet on which a color layer such as the coating layer 22 is disposed. Alternatively, the coating layer 22 may be further disposed on the top surface of the steel plate 21.

A plate hole 210 may be defined in the steel plate 21. The plate hole 210 may pass through the steel plate 21 and be configured so that the display part 11 is provided by a plurality of plate holes 210.

The plurality of plate holes 210 may be combined with each other to display one figure, character, or design. For example, the plate hole 210 may have a shape such as a plurality of "88" shape segments to express a figure. For example, the plurality of plate holes 210 may define one or more multi-segment displays, where each multi-segment display may include a plurality of segments that are configured to indicate a figure, a character, a pattern, or a number. One example of the multi-segment display is a seven-segment display including seven segments configured to indicate a single digit number. In some examples, one plate hole 210 may be configured to correspond to one unit configuration of 14 configurations having the same size, which constitute the "88" shape segments. Alternatively, the plate hole 210 is not limited to the shape of the "88" shape segments, but a plurality of the plate holes 210 may be combined with each other to express various characters or designs.

In some implementations, the plate hole 210 may be defined to have a larger size than the light transmission part 252 to be described in detail below, and a plurality of light transmission parts 252 may be positioned in an inner region of the plate hole 210.

The plate hole 210 may be defined by etching or laser processing. The plate hole 210 may be defined to be larger than the size of the light transmission part 252 that will be described below and also have a size that is capable of being processed within an error range by single etching or laser processing.

A front surface of the plate hole 210 may be covered by the coating layer 22, and the coating layer 22 may be defined over the entire front surface of the steel plate 21.

In some implementations, a hole filling member 23 may be filled into the plate hole 210. The hole filling member 23 may fill the entire inner surface of the plate hole 210. When the hole filling member 23 is filled, the front surface of the steel plate 21 and a front surface of the hole filling member 23 may be formed to be coplanar. Thus, when viewed from the outside of the door 10, a circumference of the plate hole 210 may not be visible.

The hole filling member 23 is made of a material capable of transmitting light so that the light emitted from the light emitting member 74 pass through the plate hole 210. The hole filling member 23 may be made of various materials capable of transmitting light. For example, the hole filling member 23 may be made of a urethane-based or acrylic urethane-based resin material. The hole filling member 23 filled in the plate hole 210 may be cured by ultraviolet rays or heat. Thus, the hole filling member 23 may have predetermined strength in the state of being filled in the plate hole 210 and thus prevent the out plate from moving even when the user manipulates the manipulation part 12. The hole filling member 23 may have a color corresponding to that of the steel plate 21 or the coating layer so that the plate hole 210 is not well visible from the outside.

In some implementations, a covering layer 24 may be disposed on a bottom surface of the steel plate 21, i.e., a bottom surface of the hole filling member 23. The covering layer 24 may cover the entire bottom surface of the steel plate 21 or at least the plurality of plate holes 210 to cover a rear surface of the hole filling member 23 and define a rear surface of the steel plate 21.

When the covering layer 24 is partially disposed on the rear surface of the steel plate 21, an attachment guide part 201 (see FIG. 6) displaying a position at which the covering layer 24 will be attached may be disposed on the rear surface of the steel plate 21. The covering layer 24 may be attached to the correct position of the rear surface of the steel plate 21 by the attachment guide part 201, and a plurality of light transmission parts 252 defined in the covering layer 24 may be attached to the inside of the plate hole 210.

The covering layer 24 may be made of polyethylene terephthalate (PET) or may be transparent or translucent so that light is transmitted. In some implementations, a printed layer 25 may be disposed on the covering layer 24 to partially block the light.

In detail, the printed layer 25 may be provided on the bottom surface of the covering layer 24 by a printing process such as silkscreen and may include a light blocking part 251 for blocking light and the light transmission part 252 for transmitting light. Alternatively, the printed layer 25 may be provided by a printing or transfer process in addition to the silkscreen printing as long as the light transmission part 252 having a minute size is formed.

The light blocking part 251 may be provided by the printing on a remaining region of the covering layer 24 except for the light transmission part 252 to block light emitted from the light emitting member 74. In some implementations, the light blocking part 251 may be colored and have a color corresponding to at least one of the coating layer 22, the hole filling member 23, or the steel plate 21.

The light transmission part 252 may be a portion of the printed layer 25 on which the light blocking part 251 is not disposed and may be provided in plurality at a position corresponding to the plate hole 210. The light transmission part 252 may have a minute hole shape and may have a circular or polygonal shape.

The light transmission part 252 may have a size of several hundred micrometers (about 100 μm to about 900 μm) which is difficult to uniformly process all the light transmission parts 252 at once by etching. For example, the light transmission part 252 may have a diameter of about 500 μm and be provided by the printing process so that a plurality of light transmission parts 252 having the fine and uniform size are disposed in the inner region of the plate hole 210. The light transmission part 252 may have a small size as small as possible within a range in which the identification of each of the light transmission parts 252 is possible as the shape of the light transmission part 252 is clearly and elegantly displayed through the display part. Alternatively, the size of the light transmission part 252 is not limited to the several hundred micrometers, but may be various sizes that are capable of being uniformly formed by the printing manner.

That is, the plurality of light transmission parts 252 may be disposed in one plate hole 210 constituting a unit structure of figures, characters, or a portion of a design on the display part 11.

Thus, when the light emitting member 74 is turned on to emit light to an area of the plate hole 210, the emitted light may pass through only the area of the light transmission part 252 and be visible from the outside of the plate hole 210. Thus, the plurality of light transmission parts 252 may be seen like the plurality of holes passing through the out plate 20 in the state in which the light emitting member 74 is turned on when viewed from the outside of the door 10. Here, the light transmission parts 252 may have the fine and uniform size, and the plurality of fine and uniform holes may be defined in the surface of the door 10 as if the user recognizes that the holes constitute the display part 11.

Although the covering layer 24 and the printed layer 25 are described as separate layers, since the covering layer is attached to the steel plate 21 in the state in which the light blocking part 251 and the light transmission part 252 are printed on an outer surface of the covering layer 24, the covering layer 24 and the printed layer 25 may be substantially provided as one layer.

That is, the light blocking part 251 may be provided on the surface of the covering layer 24 by the printing, and an area on which the light blocking part 251 is not provided may become the light transmission part 252.

Figure 5:
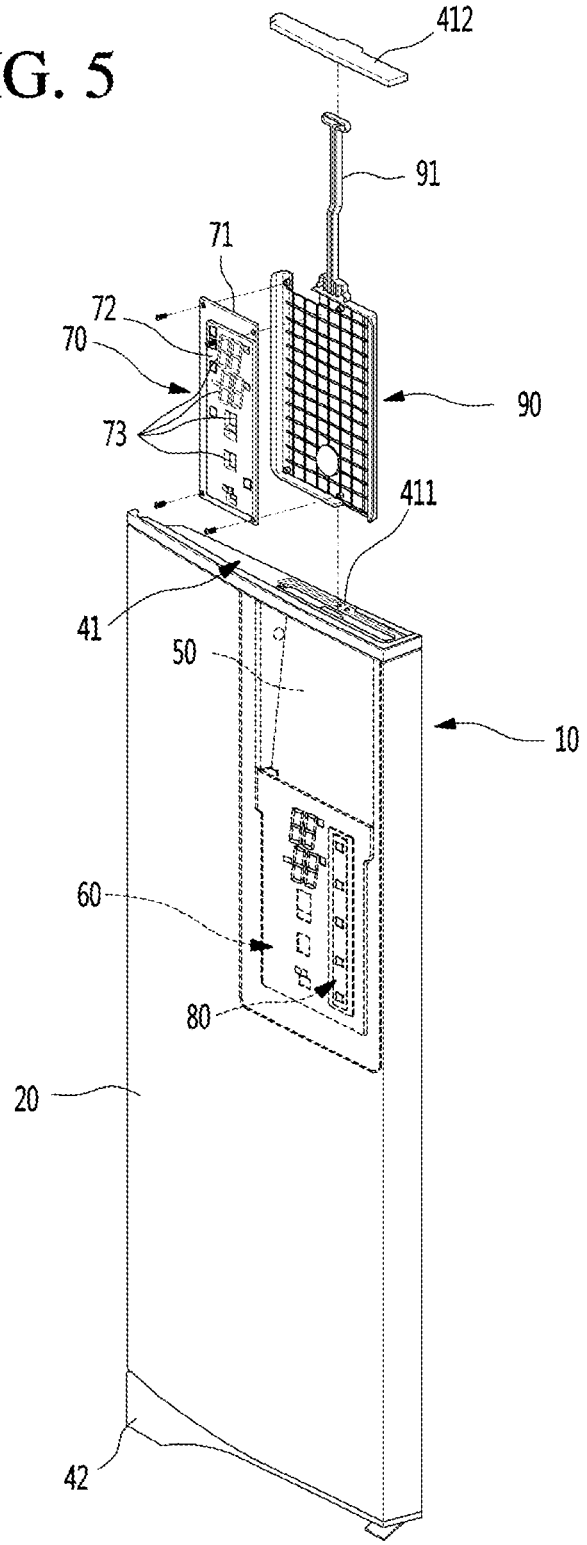
FIG. 5 is an exploded perspective view illustrating an example display assembly mounted at an example refrigerator door.

FIG. 5 is an exploded perspective view illustrating an example display assembly mounted at the refrigerator door. FIG. is an exploded perspective view illustrating an example out plate of the refrigerator door in a disassembled state.

Figure 6:
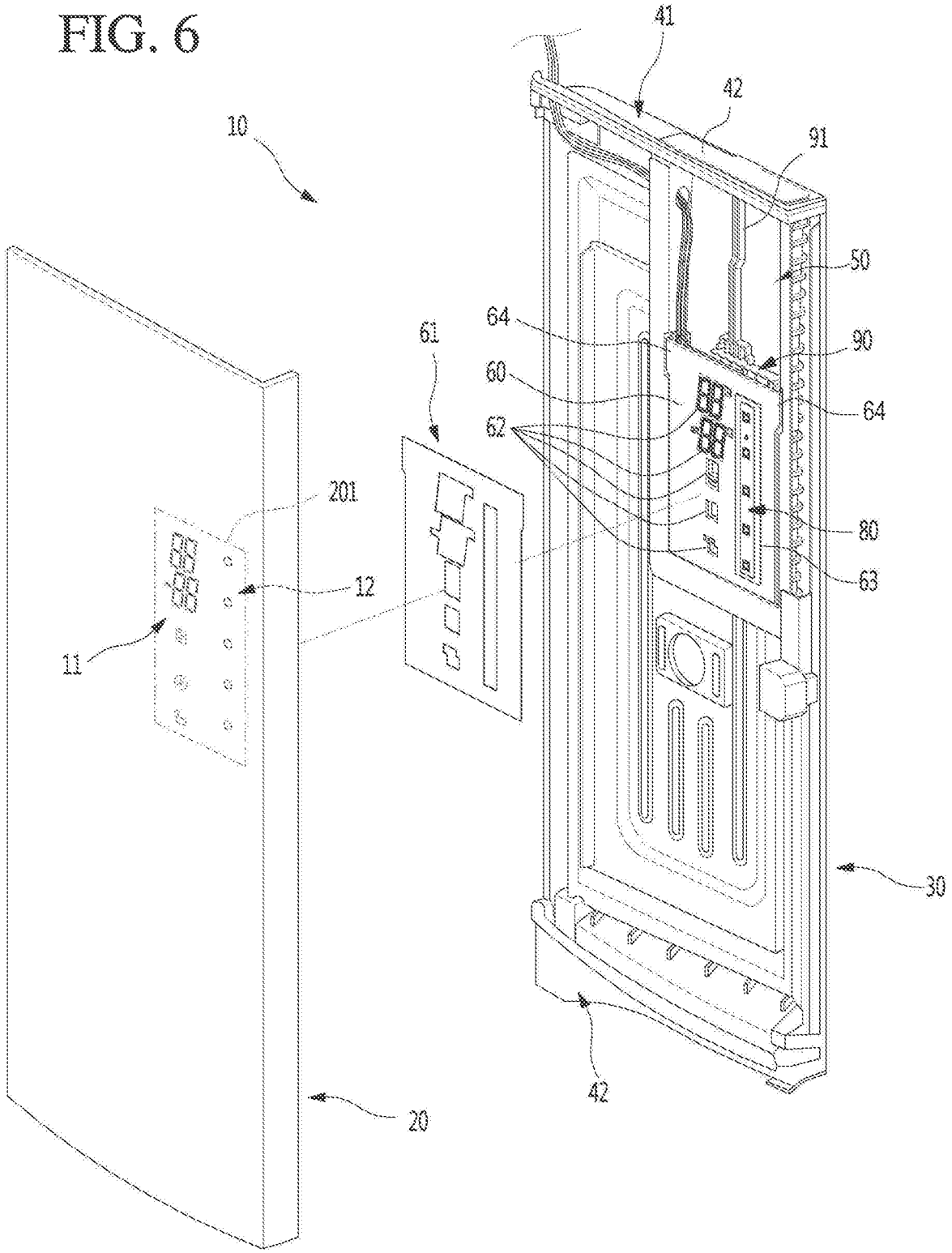
FIG. 6 is an exploded perspective view illustrating an example out plate of the refrigerator door in a disassembled state.

As illustrated in FIG. 6, the door liner 30 defining the rear surface of the door 10 may be coupled to the out plate 20 to define a surface facing the inside of the storage space. In some implementations, when the door liner 30 is coupled to the out plate 20, a space may be defined between the door liner 30 and the out plate 20. A foaming solution for forming an insulation material 202 may be filled into the space.

A frame 50 may be attached to the rear surface of the out plate 20. The frame 50 may provide a separate space in which the foaming solution is not filled into the door 10 to accommodate a display cover 60, the display assembly 70, the touch sensor assembly 80, and a display frame 90.

The cap decors 41 and 42 may define outer appearances of upper and lower portions of the door 10. The cap decors 41 and 42 may cover opened upper and lower ends of the door 10, which are defied by coupling the out plate 20 to the door liner 30.

An insertion hole 411 and an insertion hole cover 412 for opening/closing the insertion hole 411 may be disposed in/on the cap decor 41 of the cap decors 41 and 42. The insertion hole 411 may pass through the cap decor 41 to communicate with the space that is defined by the frame 50. In some implementations, the display assembly 70 may be inserted into the frame 50 through the insertion hole 411 while being coupled to the display frame 90 when the door 10 is assembled. For this, the insertion hole 411 may have a size in which the display frame 90 is insertable. In some implementations, the insertion hole 411 may be vertically defined above the display cover 60.

The display cover 60 is attached to the rear surface of the out plate 20. The display cover 60 may guide mounting of the display assembly 70. The display cover 60 may be attached to the rear surface of the out plate 20 by a double-sided tape or an adhesion member 61 coated with primer.

A frame guide 64 for guiding the insertion of the display frame 90 may be disposed on each of both sides of the display cover 60. In some implementations, a first through-hole corresponding to the plate hole 210 may be opened in the display cover 60 so that light is transmitted through the light emitting member 74 when the light emitting member 74 is turned on. The first through-hole 62 may have a size and shape corresponding to those of each of the plurality of plate holes 210 or may have a size that is enough to accommodate the plate holes 210. Thus, when the display cover 60 is attached, the plate hole 210 and the first through-hole 62 may be aligned with each other to communicate with each other.

The display assembly 70 is inserted into the space within the frame 50 through the insertion hole 411 in the state where the display assembly 300 is mounted display frame 90. When the display frame 90 is completely inserted, the display assembly 70 may be disposed inside the display cover 60 so that the plate hole 210, the first through-hole 62, and a second through-hole of the display assembly 70 are aligned with each other. Thus, light emitted from the light emitting member 74 may pass through the display cover 60 and the display part 11 and then be emitted to the outside.

In some implementations, a sensor mounting part 63 on which the touch sensor assembly 80 is mounted may be opened at the other side of the display cover 60. The touch sensor assembly 80 may contact the rear surface of the out plate 20 when the display cover 60 adheres to the out plate 20 in the state of being mounted on the sensor mounting part 63. Here, the touch sensor assembly 80 may be disposed at a position corresponding to that of the manipulation part 12. For example, the touch sensor assembly 80 may be located at the door at a position spaced apart by a predetermined distance from the display part 11. When the manipulation part 12 is manipulated, the touch sensor assembly 80 may recognize the user's manipulation.

The display assembly 70 may include a display PCB 71 on which the light emitting member 74 is mounted and a reflector 72 disposed on a front surface of the display PCB 71.

The reflector 72 may have the second through-hole 73 for guiding light of the light emitting member 74. The second through-hole 73 may be defined at a position corresponding to the first through-hole 62 and have a size corresponding to that of the first through-hole 62. In some implementations, the light emitting member 74 may be disposed inside the second through-hole 73. Thus, when the light emitting member 74 is turned on, light may sequentially pass through the corresponding second through-hole 73 and first through-hole 62 and then be emitted by passing through the light transmission part 252 in the inner region of the corresponding plate hole 210. Thus, only the corresponding area of the entire display part 11 may be illuminated to display and transmit information.

The display frame 90 may have a plate shape on which the display assembly 70 is mounted, and a frame handle 91 extending upward may be disposed at a central portion of an upper end of the display frame 90. The frame handle 91 may be a portion that is griped by the user when the display frame 90 is inserted into the display cover 60 or withdrawn from the display cover 60 and may extend up to a position adjacent to the insertion hole cover 412.

Figure 7:
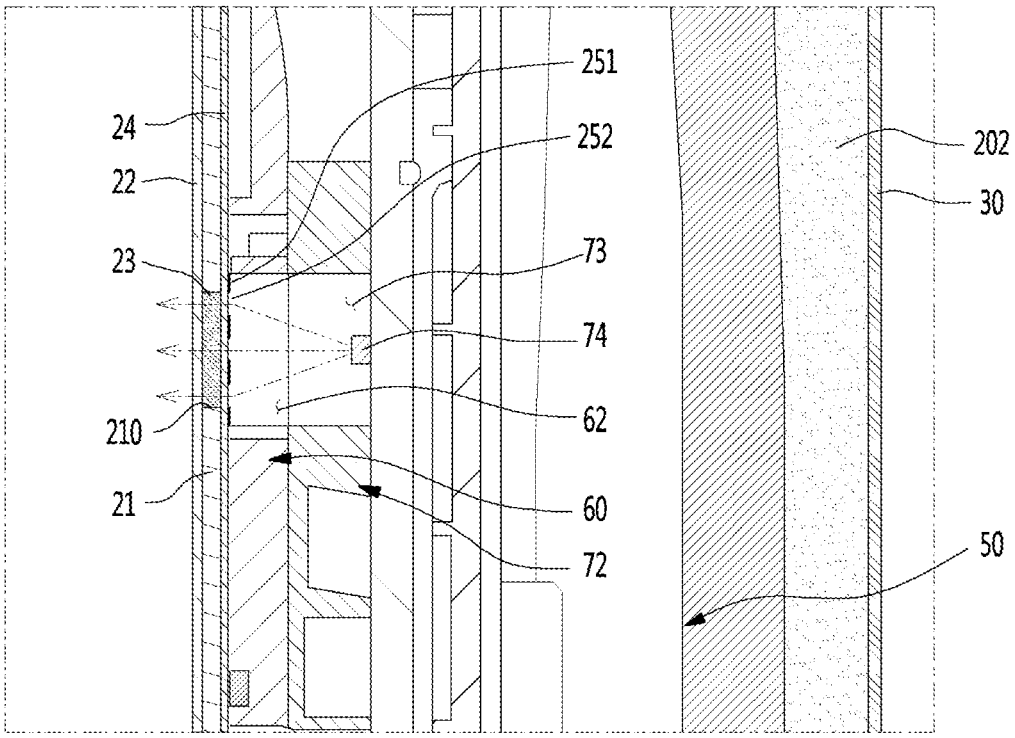
FIG. 7 is a cross-sectional view illustrating the display part taken along line 7-7' of FIG. 2.

FIG. 7 is a cross-sectional view illustrating the display part taken along line 7-7' of FIG. 2.

Referring to FIG. 7, the display cover 60 is attached to the rear surface of the out plate 20 by the adhesion member 61, and the plate hole 210 may communicate with the second through-hole 73 and the first through-hole 62 in a state in which the display frame is completely inserted. Here, the light transmission part 252 may have a small size to be much smaller than that of each of the plate hole 210 and the first through-hole 62 and the second through-hole 73, and the plurality of the light transmission parts 252 may be disposed in the inner region of the one plate hole 210.

In some implementations, the plurality of light emitting members 74 provided in the display assembly 70 may be independently disposed in a region corresponding to each of the plate holes 210. That is, each of the light emitting members 74 may be disposed inside the second through-hole 73 to illuminate the plurality of light transmission parts 252 disposed in the plate holes 210 of the corresponding region according to the turn on/off of the light emitting member 74.

Thus, the second through-hole 73, the first through-hole 62, and the plate hole 210 may communicate with each other, and the light emitted from the light emitting member 74 may sequentially pass through the second through-hole 73, the first through-hole 62, and the light transmission part 252 on the plate hole 210 and then be emitted to the outside of the door 10.

Here, the light passing through the first through-hole 62 may pass through the plurality of light transmission parts 252 disposed on the rear surface of the plate hole 210 and thus may not pass through the region of the light blocking part. Thus, when viewed from the outside, the display part 11 may display the information by the plurality of light transmission parts 252 through which the light passes. In some implementations, the figure, the character, or the design displayed through the minute holes defined by the plurality of light transmission parts 252 may be seen to be shining.

Figure 8A:
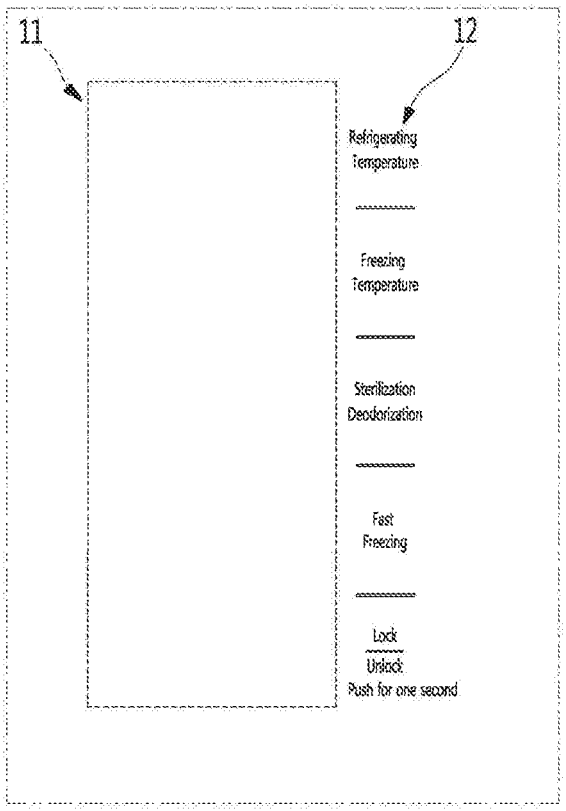
FIG. 8A is a view illustrating an example display part that is turned off.
Figure 8B:
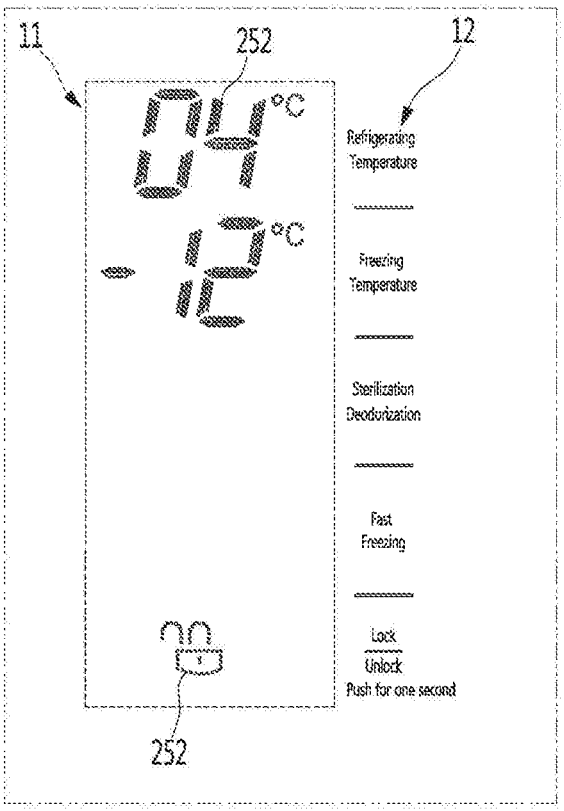

FIG. 8A is a view illustrating an example display part that is turned off, and FIG. 8B is a view illustrating an example display part that is turned on.

As illustrated in FIGS. 8A and 8B, the display part 11 may be provided by the plurality of light transmission parts 252 and may display the form of a figure and symbol constituted by a multi-segment display such as the "88" shape segments according to the turn on/off of the light emitting member 74.

In detail, as illustrated in FIG. 8A, the display part 11 may be configured so that the light transmission part 252 is not exposed to the outside in the state in which the light emitting member 74 of the display assembly 70 is not turned on.

In detail, the coating layer 22 may have a color or a specific texture and also have a property of transmitting light. Thus, in the state in which the light of the light emitting member 74 is not emitted from the inside of the door 10, the inner region of the door 10, in which the light transmission part 252 is disposed may become relatively dark and thus may not be visible from the outside.

As described above, the coating layer 22 of the color steel plate may cover the light transmission part 252 so that the light transmission part 252 is not visible from the outside in the state in which no light is emitted. Thus, the door 10 may be seen as having no display on the front surface thereof.

In this state, when the user touches the manipulation part 12, or the light emitting member 74 is turned on by a preset operation, the light emitted from the light emitting member 74 may sequentially pass through the first through-hole 62, the second through-hole 73, and the light transmission part 252 and then be emitted to the outside.

Here, a portion of the plurality of light transmission parts 252 may emit light according to the turn on/off state of the light emitting member 74, and the remaining light transmission parts 252 may not emit light and thus be invisible by the user. As described above, the light transmission parts 252 through which light emitted from the LED passes to be emitted may be combined with each other to display the form of a specific figure, character, or symbol to the outside.

For example, as illustrated in FIG. 8B, when a specific light emitting member 74 of the plurality of light emitting members 74 is turned on, the light passing through the light transmission parts 252 disposed inside a portion of the plurality of plate holes 210 may be emitted to display the form of a figure having information such as 4° C. and −12° C. as illustrated in FIG. 8B. That is, the information may be displayed through the front surface of the door 10 in various forms by the combination of the light transmission parts 252 that are turned on in the state in which a separate display is not visible on the front surface of the door 10.

Hereinafter, an example method for manufacturing an exterior member having the above-described structure will be described.

Figure 9:
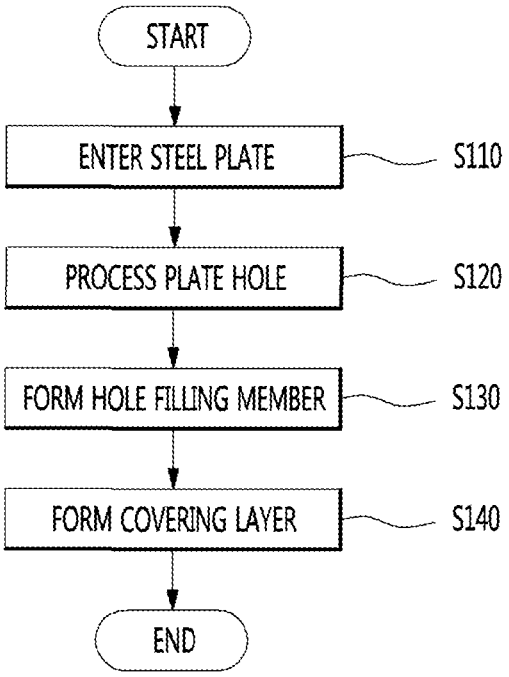
FIG. 9 is a view sequentially illustrating a process of defining the display part on the out plate.
Figure 10A:
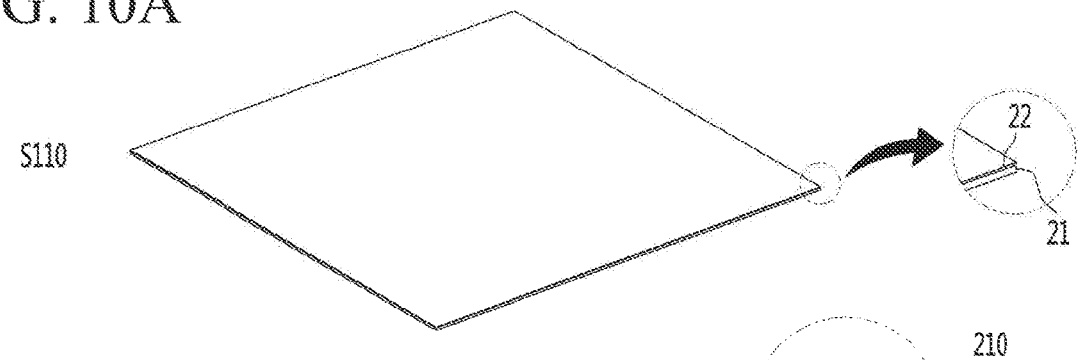
FIGS. 10A to 10D are perspective views illustrating a sequence of an example process of defining the display part.
Figure 10B:
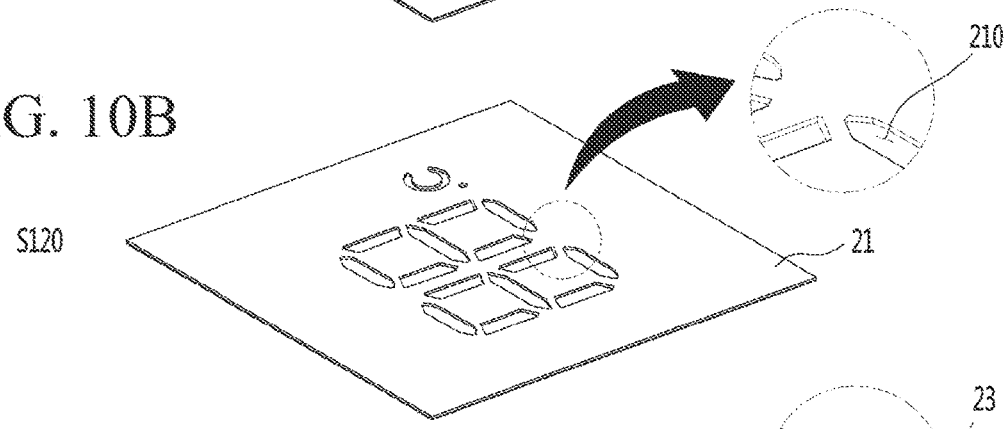
Figure 10C:
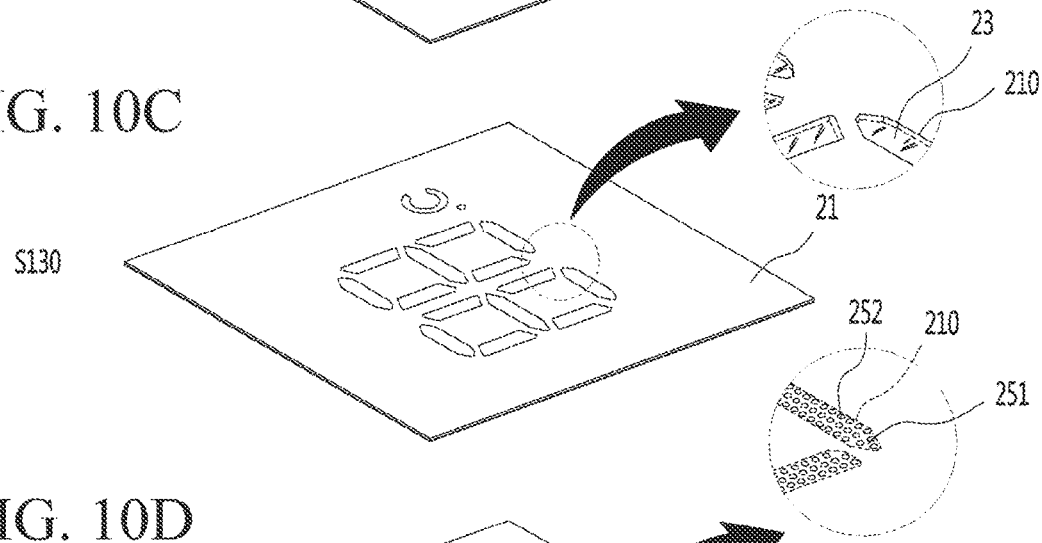
Figure 10D:
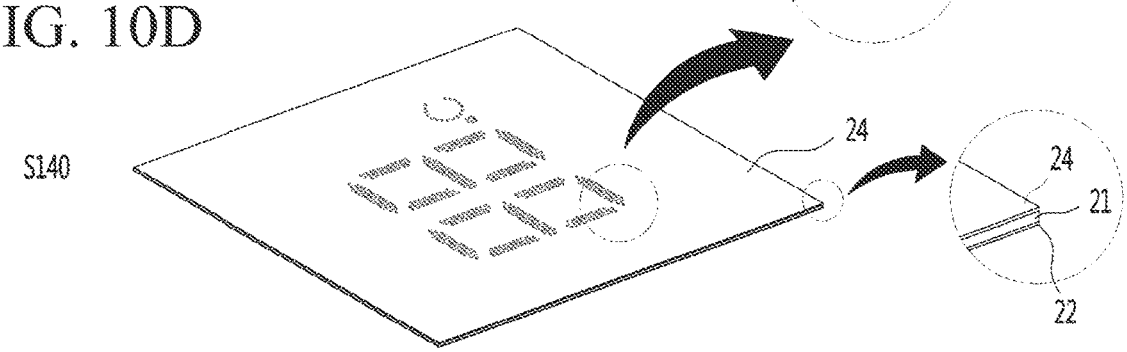
Figure 11A:
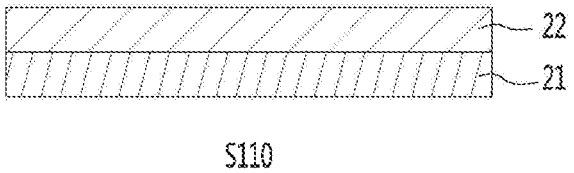
FIGS. 11A to 11D are cross-sectional views illustrating a sequence of an example process of defining the display part.
Figure 11B:
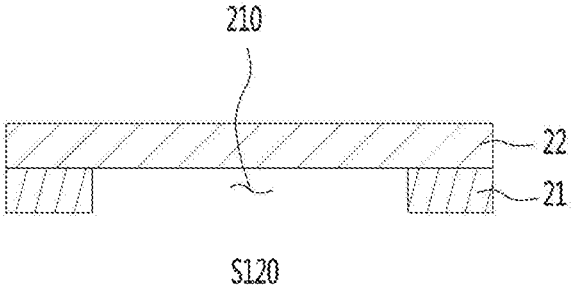
Figure 11C:
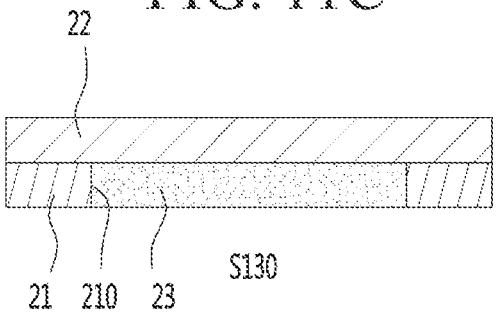
Figure 11D:
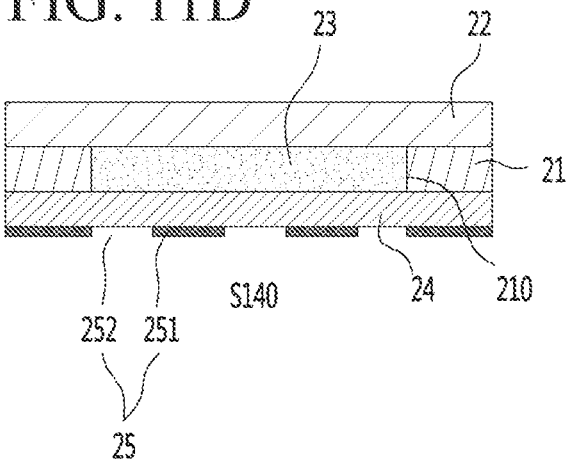

FIG. 9 is a view sequentially illustrating an example process of defining the display part on the out plate. FIGS. 10A to 10D are perspective views illustrating a sequence of an example process of defining the display part. FIGS. 11A to 11D are cross-sectional views illustrating a sequence of an example process of defining the display part.

As illustrated in the drawings, to form the out plate 20 of the refrigerator 1, a steel plate (for example, a stainless steel plate or VCM plate) used as a material for forming the out plate 20 may be additionally processed to be cut by an adequate length and bent.

Here, when the steel plate 21 to be supplied is the VMC steel plate, the coating layer 22 for forming a color on the surface may be further formed. In some implementations, even in the case of the stainless steel plate, the coating layer 22 for preventing the surface from being damaged, preventing fingerprints from being formed, and forming a specific color or pattern may be further formed. Alternatively, the coating layer 22 may be formed as needed after the etching, the formation of the hole filling member, or the formation of the covering layer 24 [S110].

The steel plate 21 processed in a specific size and shape may be etched. Here, the etching process may be performed through various manners. The plate hole 210 may be formed by a wet etching manner using ferric chloride ($FeCl_3$) as an etchant so as to pass through the steel plate 21 made of the metal material.

The plate hole 210 may have a size that is enough to be formed by a single etching process in the plate-shaped out plate 20. In some implementations, the plate hole 210 may have a size that is enough to constitute a portion of figure or design displayed on the display part 11. For example, one plate hole 210 may have a size and shape corresponding to those of one unit constituting a multi-segment display such as the "88" shape segments including fourteen pieces or segments.

Alternatively, the plate holes 210 may be formed by a processing method other than the etching and may be formed through processing such as laser processing [S120].

In the state in which the plate hole 210 is formed, the hole filling member 23 may be formed in the plate hole 210. The inside of the plate hole 210 may be filled with the hole filling member 23 to prevent corrosion inside the plate hole 210. In some implementations, when the light emitting member 74 is not turned on, the plate hole 210 may not be visible from the outside.

The hole filling member 23 may be filled in the rear surface of the steel plate 21 by the silkscreen printing manner and may be processed to fill the plurality of the plate holes 210 at a time by a squeezing manner. In some implementations, an outer surface of the hole filling member 23 filled in the plate hole 210 may be uniformly formed without being uneven. In some implementations, the hole filling member 23 may be cured by irradiating ultraviolet rays or exposed to heat and may reinforce the strength of the portion at which the plate hole 210 is formed [S130].

The covering layer 24 may be formed on the rear surface of the steel plate 21 in the state in which the hole filling member 23 is formed. The covering layer 24 may be made of a resin film such as polyethylene terephthalate (PET) and may be laminated on the rear surface of the steel plate 21 to adhere.

In some implementations, the covering layer 24 may have a size that is enough to cover at least the plurality of plate holes 210 in the region inside the display part 11 rather than the whole steel plate 21. Here, the covering layer 24 may be attached according to the attachment guide part 201 displayed on the rear surface of the steel plate 21 so that the covering layer 24 is attached at an accurate position. The attachment guide part 201 may be laser-marked at the correct position, the attachment site may be displayed by the etching during the etching process, and may be marked by a tool capable of displaying a line.

The covering layer 24 may be laminated to the steel plate 21 in the state in which the printed layer 25 is formed. The printed layer 25 may be formed on the rear surface of the covering layer 24 by the printing to form the light blocking part 251 and the light transmission part 252.

Here, the plurality of light transmission parts 252 that are printed finely may be disposed in the inner region of one plate hole 210, and the unit holes constituted by a multi-segment display such as the "88" shape segments formed in the plate hole 210 may be formed [S140].

The implementations of the present disclosure may be variously modified in addition to the above-described implementations. Hereinafter, the implementations will be described in further detail with reference to the accompanying drawings. In some implementations, the same reference numeral is used for the same component as those of the foregoing first implementation among the components of the other implementations, and a detailed description thereof will be omitted.

Figure 12:
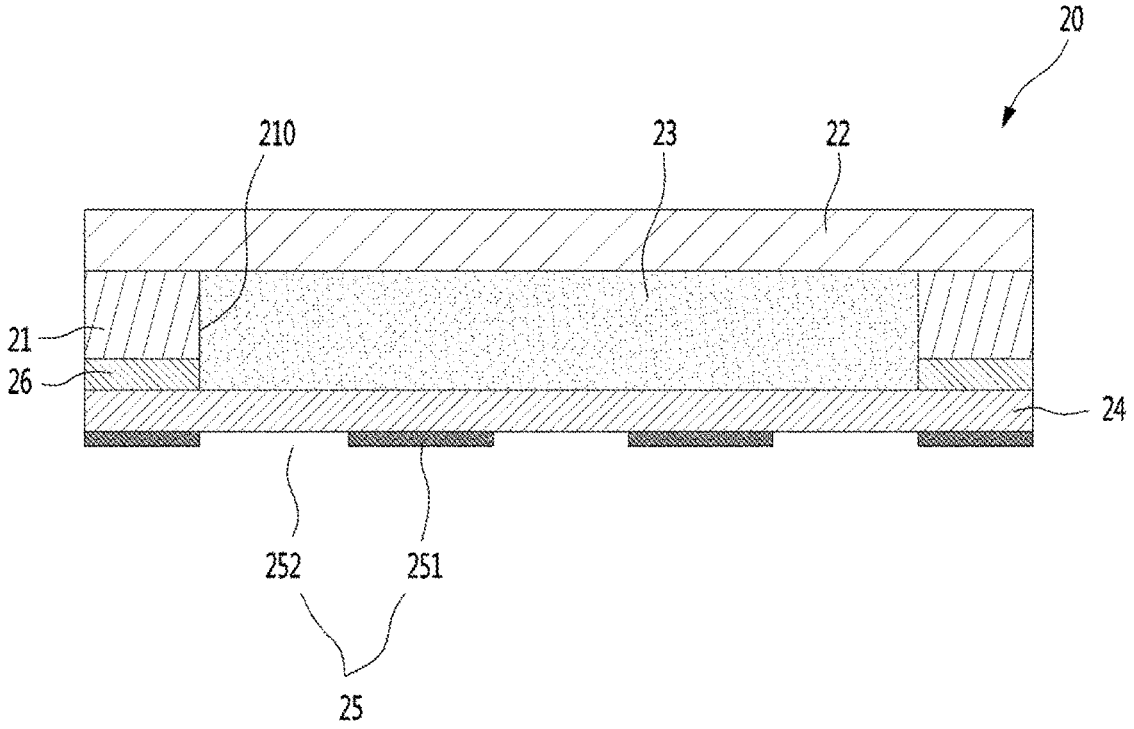
FIG. 12 is a cross-sectional view illustrating an example display part according to a second implementation.

FIG. 12 is a cross-sectional view illustrating an example display part according to a second implementation.

As illustrated in FIG. 12, an out plate 20 according to a second implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 210 may be defined in the steel plate 21.

In some implementations, a coating layer 22 may be disposed on a front surface of the steel plate 21, i.e., the top surface. The coating layer 22 may cover the plate hole 210 passing through the steel plate 21 at an upper side to define an outer appearance of the front surface of the out plate 20. The front surface of the out plate 20 may have a texture and a color of an outer appearance thereof by the coating layer 22.

In some implementations, a back coating layer 26 may be disposed on a bottom surface of the steel plate 21, i.e., the rear surface. The back coating layer 26 protects the rear surface of the steel plate 21 and forms a thin film on the rear surface of the steel plate to realize chemical resistance and corrosion resistance. The surface of the steel plate 21 may be stabilized by the back coating layer 26, and the corrosion may be prevented.

In some implementations, the back coating layer 26 may be removed by an area corresponding to the plate hole 210 when the plate hole 210 is defined. In some implementations, the plate hole 210 may be defined through etching in a region in which the back coating layer 26 is removed from the steel plate 21.

A hole filling member 23 may be disposed in the plate hole 210. The hole filling member 23 may be made of a light transmitting material and may be cured by ultraviolet ray or heat in the state in which the plate hole 210 is completely filled.

A covering layer 24 may be disposed on a lower surface of the steel plate 21 in the state in which the hole filling member 23 is filled in the plate hole 210. A printed layer 25 may be disposed on a rear surface of the covering layer 24. The printed layer 25 may include a light blocking part 251 and a light transmission part 252.

Here, the light transmission part 252 may be provided by printing the light blocking part 251 and may have a fine and uniform circular shape. A plurality of the light transmission parts 252 may be disposed in an inner region of the plate hole 210 to allow light emitted from the light emitting member 74 to pass therethrough. An area outside the light transmission part 252 may block the light emitted from the light emitting member 74 to prevent the light from being transmitted to the light blocking part 251.

When the light emitting member 74 disposed at a position corresponding to the plate hole 210 is turned on, light emitted from the light emitting member 74 may sequentially pass through the light transmission part 252 of the covering layer 24, the hole filling member 23, and the coating layer 22 and then be emitted to the outside.

Thus, the display part 11 may be shined in the form of a figure, character, or symbol by the light transmission part 252 disposed in the inner region of the plate hole 210 corresponding to the plurality of light emitting members 74, which are turned on, when viewed from the outside, thereby transmitting information to a user.

Figure 13:
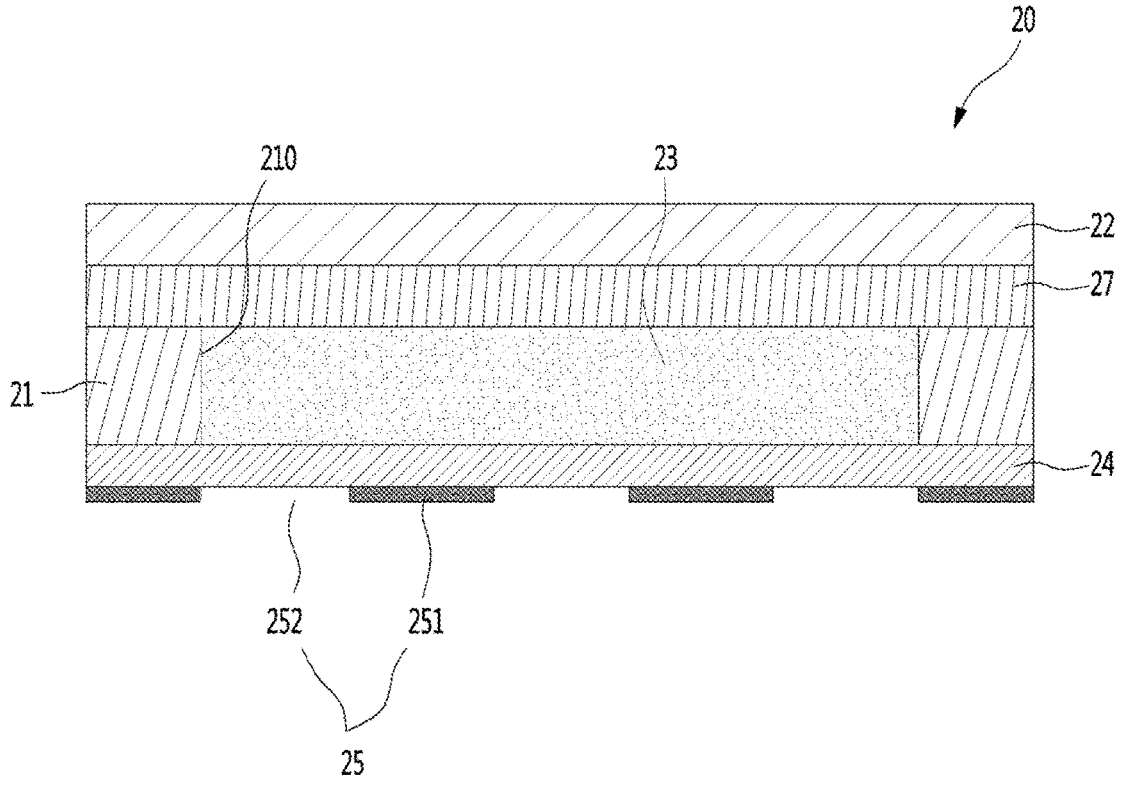
FIG. 13 is a cross-sectional view illustrating an example display part according to a third implementation.

FIG. 13 is a cross-sectional view illustrating an example display part according to a third implementation.

As illustrated in FIG. 13, an out plate 20 according to a third implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 210 may be defined in the steel plate 21.

In some implementations, a reinforcement layer 27 may be disposed on a front surface of the steel plate 21, i.e., the top surface. The reinforcement layer 27 may be made of a resin film such as polyethylene terephthalate (PET) and be disposed on a top surface of the steel plate 21 to reinforce strength of an area of the display part 11 of the steel plate 21 in which a plurality of plate holes 210 are defined.

Particularly, when the manipulation part 12 is disposed at a position adjacent to the display part 11, the plate hole 210 may be formed by repetitive manipulation of the manipulation part 12 to deform the area of the display part 11. However, the reinforcement layer 27 may be provided to maintain the shape of the steel plate 21 without deforming the steel plate 21.

The reinforcement layer 27 may be laminated on a surface of the steel plate 21 in the form of a film and may have a thickness of about 100 μm to about 150 μm. When the thickness of the reinforcement layer 27 is thinner than 100 μm, the reinforcement layer 27 may be contracted together with the hole filling member 23 and thus be deformed when the hole filling member 23 is contracted. In some implementations, when the thickness of the reinforcement layer 27 is thicker than 150 μm, a tolerance of a mold may be generated during a molding process of the steel plate 21, such as bending of the steel plate 21, and thus, it may be difficult to process the steel plate 21.

Alternatively, the reinforcement layer 27 may be made of a different transparent material, i.e., a material that is capable of transmitting light and being maintained in adhesion with the steel plate 21 and the coating layer 22.

The coating layer 22 may be disposed on a front surface of the reinforcement layer 27, i.e., the top surface. The coating layer 22 may define an outer appearance of the front surface of the out plate 20. The front surface of the out plate 20 may have a texture and a color of an outer appearance thereof by the coating layer 22 and may include a functional coating layer having an anti-fingerprint property.

As necessary, the coating layer 22 may be omitted. Here, the reinforcement layer 27 may have a color or a pattern to serve as the coating layer 22.

The plate hole 210 passing through the steel plate 21 may be defined in the steel plate 21. The plate holes 210 are defined by etching or the like, and a plurality of the plate holes 210 may be defined to display figures, characters, or patterns constituting the display part 11.

A hole filling member 23 may be disposed in the plate hole 210. The hole filling member 23 may be made of a light transmitting material and may be cured in the state in which the plate hole 210 is completely filled.

A covering layer 24 may be disposed on a lower surface of the steel plate 21 in the state in which the hole filling member 23 is filled in the plate hole 210. A printed layer 25 may be disposed on a rear surface of the covering layer 24. The printed layer 25 may be provided with a light blocking part 251 and a light transmission part 252.

Here, the light transmission part 252 may be provided by printing the light blocking part 251 and may have a fine and uniform circular shape. A plurality of the light transmission parts 252 may be disposed in an inner region of the plate hole 210 to allow light emitted from the light emitting member 74 to pass therethrough. An area outside the light transmission part 252 may block the light emitted from the light emitting member 74 to prevent the light from being transmitted to the light blocking part 251.

When the light emitting member 74 disposed at a position corresponding to the plate hole 210 is turned on, light emitted from the light emitting member 74 may sequentially pass through the light transmission part 252 of the covering layer 24, the hole filling member 23, and the coating layer 22 and then be emitted to the outside.

Thus, the display part 11 may be shined in the form of a figure, character, or symbol by the light transmission part 252 disposed in the inner region of the plate hole 210 corresponding to the plurality of light emitting members 74, which are turned on, when viewed from the outside, thereby transmitting information to a user.

Figure 14:
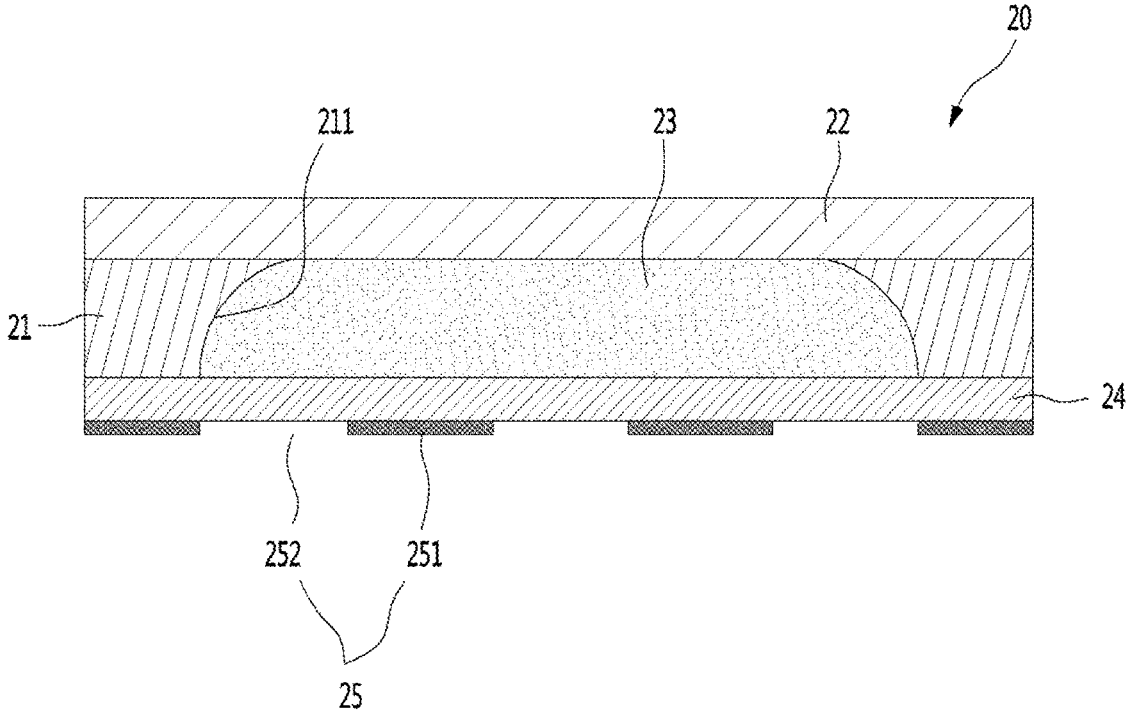
FIG. 14 is a cross-sectional view illustrating an example display part according to a fourth implementation.

FIG. 14 is a cross-sectional view illustrating an example display part according to a fourth implementation.

As illustrated in FIG. 14, an out plate 20 according to a fourth implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 211 may be defined in the steel plate 21.

A coating layer 22 may be disposed on a front surface of the steel plate 21, i.e., the top surface. The coating layer 22 may define an outer appearance of the front surface of the out plate 20 and also cover the plate hole 211 defined to pass through the steel plate 21. The front surface of the out plate 20 may have a texture and a color of an outer appearance thereof by the coating layer 22 and may include a functional coating layer having an anti-fingerprint property.

The plate holes 211 are defined by etching or the like, and a plurality of the plate holes 210 may be defined to display figures, characters, or patterns constituting the display part 11. In some implementations, the plate hole 211 may have a shape that gradually increases in width downward. That is, the plate hole 211 may have a circumference that is inclined or rounded. An opened bottom surface of the plate hole 211 may have the widest width and then be narrowed upward.

In some implementations, a hole filling member 23 may be disposed in the plate hole 211. The hole filling member 23 may be made of a light transmitting material and may be cured in the state in which the plate hole 211 is completely filled.

The hole filling member 23 may be filled into the plate hole 211 defined in the rear surface of the steel plate 21. Thus, the hole filling member 23 may be filled to prevent a non-filled region from occurring in the plate hole 211 due to the characteristics in shape of the plate hole 211 having a wide inlet at which the filling of the hole filling member starts. In some implementations, the plate hole 211 may be filled with the hole filling member 23 without generating bubbles during the process of forming the hole filling member 23.

A covering layer 24 may be disposed on a lower surface of the steel plate 21 in the state in which the hole filling member 23 is filled in the plate hole 211. A printed layer 25 may be disposed on a rear surface of the covering layer 24. The printed layer 25 may include a light blocking part 251 and a light transmission part 252.

Here, the light transmission part 252 may be provided by printing the light blocking part 251 and may have a fine and uniform circular shape. A plurality of the light transmission parts 252 may be disposed in an inner region of the plate hole 211 to allow light emitted from the light emitting member 74 to pass therethrough. An area outside the light transmission part 252 may block the light emitted from the light emitting member 74 to prevent the light from being transmitted to the light blocking part 251.

When the light emitting member 74 disposed at a position corresponding to the plate hole 211 is turned on, light emitted from the light emitting member 74 may sequentially pass through the light transmission part 252 of the covering layer 24, the hole filling member 23, and the coating layer 22 and then be emitted to the outside.

Thus, the display part 11 may be shined in the form of a figure, character, or symbol by the light transmission part 252 disposed in the inner region of the plate hole 211 corresponding to the plurality of light emitting members 74, which are turned on, when viewed from the outside, thereby transmitting information to a user.

Figure 15:
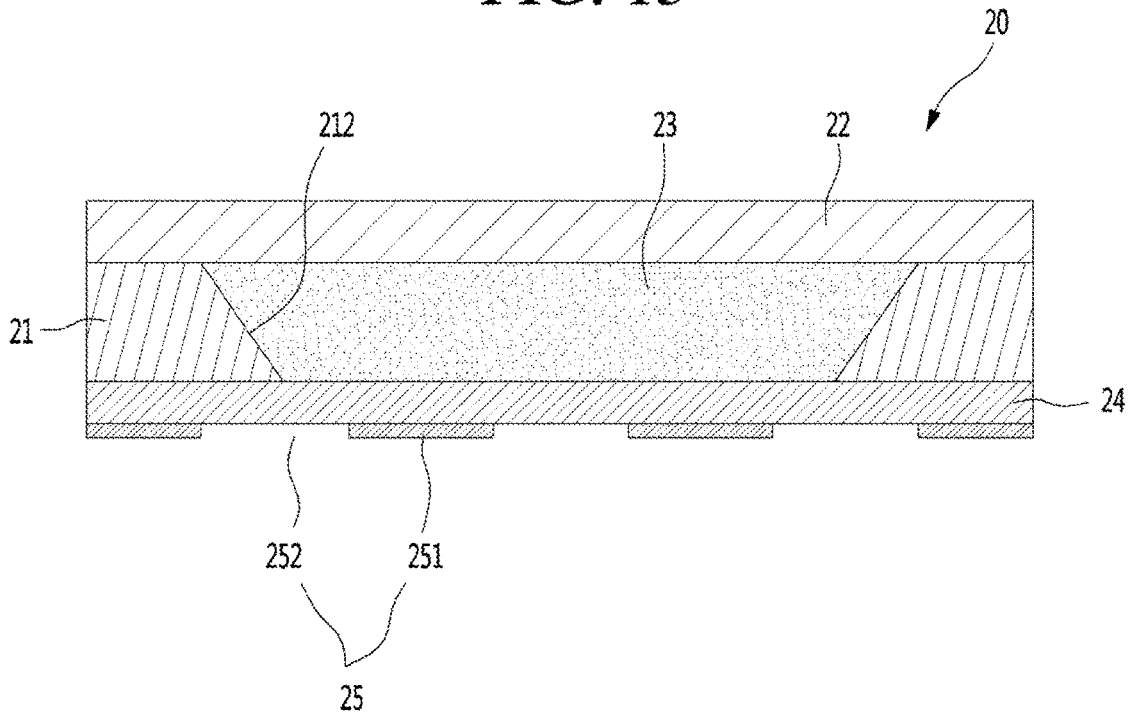
FIG. 15 is a cross-sectional view illustrating an example display part according to a fifth implementation.

FIG. 15 is a cross-sectional view illustrating an example display part according to a fifth implementation.

As illustrated in FIG. 15, an out plate 20 according to a fifth implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 212 may be defined in the steel plate 21.

A coating layer 22 may be disposed on a front surface, i.e., a top surface of the steel plate 21. The coating layer 22 may define an outer appearance of the front surface of the out plate 20 and also cover the plate hole 212 defined to pass through the steel plate 21. The front surface of the out plate 20 may have a texture and a color of an outer appearance thereof by the coating layer 22 and may include a functional coating layer having an anti-fingerprint property.

The plate holes 212 are defined by etching or the like, and a plurality of the plate holes 210 may be defined to display figures, characters, or patterns constituting the display part 11. In some implementations, the plate hole 212 may have a shape that gradually increases in width upward. That is, the plate hole 212 may have a circumference that is inclined or rounded. An opened bottom surface of the plate hole 211 may have the narrowest width and then be widened upward.

In some implementations, a hole filling member 23 may be disposed in the plate hole 212. The hole filling member 23 may be made of a light transmitting material and may be cured in the state in which the plate hole 212 is completely filled.

The hole filling member 23 may be filled into the plate hole 212 defined in the rear surface of the steel plate. Here, the hole filling member 23 may be filled into the plate hole 212 opened at the rear surface of the steel plate 21 in the same state as a fluid having fluidity.

Although the hole filling member 23 is injected into the plate hole 212 having a narrow inlet, the hole filling member 23 may be completely filled into the entire region of the plate hole 212 having the gradually increasing width due to low viscosity.

In some implementations, after the hole filling member 23 is completely filled, the hole filling member 23 may be cured by ultraviolet rays or heat and then be completely hardened in the plate hole 212.

Since the plate hole 212 has a structure that is gradually narrowed downward, the hole filling member 23 cured in the plate hole 212 may not be delaminated through an opening of the plate hole 212 due to the structural characteristics of the hole filling member 23 and thus be maintained in the state of covering the plate hole 212.

A covering layer 24 may be disposed on a lower surface of the steel plate 21 in the state in which the hole filling member 23 is filled in the plate hole 212. A printed layer 25 may be disposed on a rear surface of the covering layer 24. The printed layer 25 may include a light blocking part 251 and a light transmission part 252.

Here, the light transmission part 252 may be provided by printing the light blocking part 251 and may have a fine and uniform circular shape. A plurality of the light transmission parts 252 may be disposed in an inner region of the plate hole 212 to allow light emitted from the light emitting member 74 to pass therethrough. An area outside the light transmission part 252 may block the light emitted from the light emitting member 74 to prevent the light from being transmitted to the light blocking part 251.

When the light emitting member 74 disposed at a position corresponding to the plate hole 212 is turned on, light emitted from the light emitting member 74 may sequentially pass through the light transmission part 252 of the covering layer 24, the hole filling member 23, and the coating layer 22 and then be emitted to the outside.

Thus, the display part 11 may be shined in the form of a figure, character, or symbol by the light transmission part 252 disposed in the inner region of the plate hole 212 corresponding to the plurality of light emitting members 74, which are turned on, when viewed from the outside, thereby transmitting information to a user.

Figure 16:
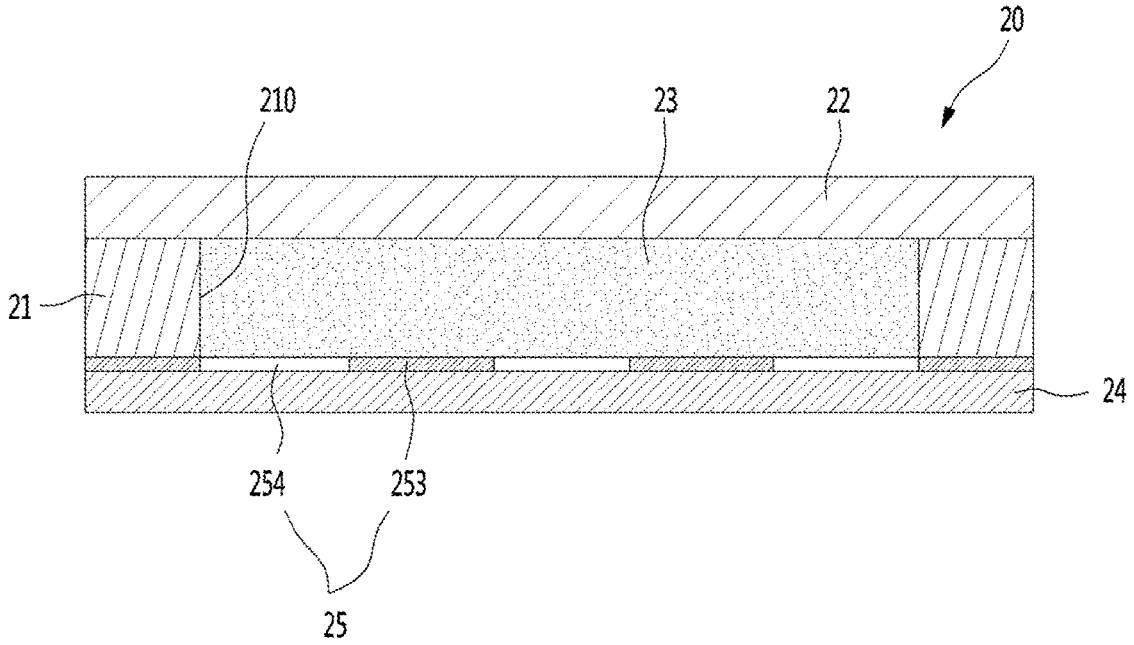
FIG. 16 is a cross-sectional view illustrating an example display part according to a sixth implementation.

FIG. 16 is a cross-sectional view illustrating an example display part according to a sixth implementation.

As illustrated in FIG. 16, an out plate 20 according to a sixth implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 210 may be defined in the steel plate 21.

In some implementations, a coating layer 22 may be disposed on a front surface, i.e., a top surface of the steel plate 21. The coating layer 22 may cover the plate hole 210 passing through the steel plate 21 at an upper side to define an outer appearance of the front surface of the out plate 20. The front surface of the out plate 20 may have a texture and a color of an outer appearance thereof by the coating layer 22.

A hole filling member 23 may be disposed in the plate hole 210. The hole filling member 23 may be made of a light transmitting material and may be cured in the state in which the plate hole 210 is completely filled.

A covering layer 24 may be disposed on a lower surface of the steel plate 21 in the state in which the hole filling member 23 is filled in the plate hole 210. A printed layer 25 may be disposed on a top surface of the covering layer 24. The printed layer 25 may include a light blocking part 253 and a light transmission part 254.

That is, the light blocking part 253 and the light transmission part 254 may be provided on a surface of the covering layer 24 through printing. In some implementations, the light transmission part 254 may have a fine and uniform circular shape. A plurality of the light transmission parts 254 may be disposed in an inner region of the plate hole 210 to allow light emitted from the light emitting member 74 to pass therethrough. An area outside the light transmission part 254 may block the light emitted from the light emitting member 74 to prevent the light from being transmitted to the light blocking part 253.

The covering layer 24 may be attached to the steel plate 21 in a state in which a top surface of the covering layer 24, on which the light blocking part 253 and the light transmission part 254 are disposed, contacts bottom surfaces of the steel plate 21 and the hole filling member 23. That is, a film type covering layer 24 on which the light blocking part 253 and the light transmission part 254 are printed may be attached to the rear surface of the steel plate 21.

When the light emitting member 74 disposed at a position corresponding to the plate hole 210 is turned on, light emitted from the light emitting member 74 may sequentially pass through the light transmission part 254 of the covering layer 24, the hole filling member 23, and the coating layer 22 and then be emitted to the outside.

Thus, the display part 11 may be shined in the form of a figure, character, or symbol by the light transmission part 254 disposed in the inner region of the plate hole 210 corresponding to the plurality of light emitting members 74, which are turned on, when viewed from the outside, thereby transmitting information to a user.

Figure 17:
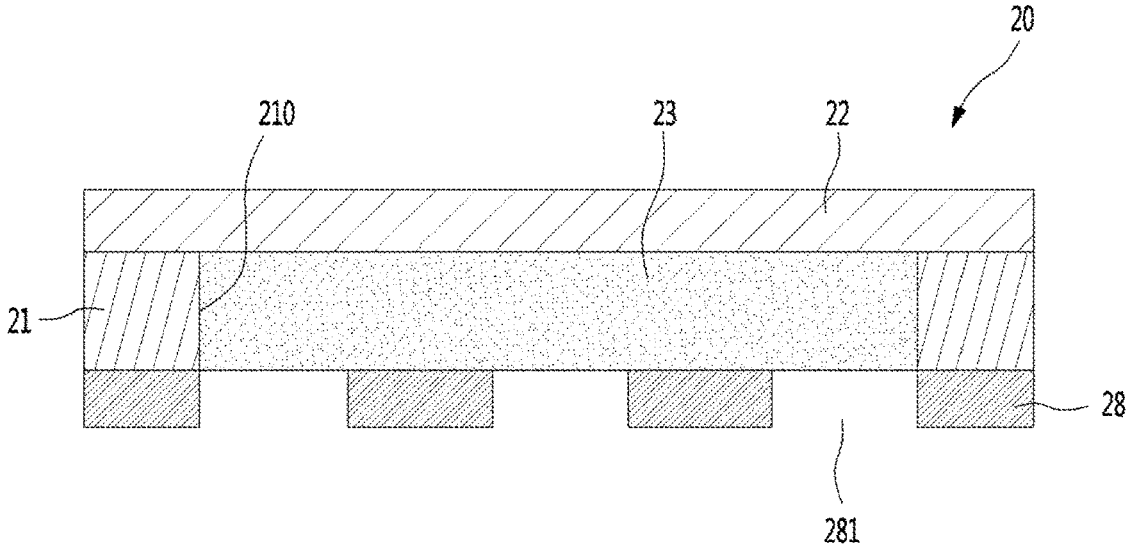
FIG. 17 is a cross-sectional view illustrating an example display part according to a seventh implementation.

FIG. 17 is a cross-sectional view illustrating an example display part according to a seventh implementation.

As illustrated in FIG. 17, an out plate 20 according to a seventh implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 210 may be defined in the steel plate 21.

In some implementations, a coating layer 22 may be disposed on a front surface of the steel plate 21, i.e., the top surface. The coating layer 22 may cover the top surface of the plate hole 210 and also define an outer appearance of the front surface of the out plate 20. The front surface of the out plate 20 may have a texture and a color of an outer appearance thereof by the coating layer 22.

A hole filling member 23 may be disposed in the plate hole 210. The hole filling member 23 may be made of a light transmitting material and may be cured in the state in which the plate hole 210 is completely filled.

In some implementations, a covering layer 28 may be disposed on a bottom surface of the steel plate 21, i.e., the rear surface. The covering layer 28 may cover the plate hole 210 and the hole filling member 23 at a lower side.

The covering layer 28 may be made of a light blocking material and have a light blocking color. For example, the covering layer 28 may be made of a black pigment film material and be attached to cover the plate holes 210. In some implementations, a plurality of light transmission parts 281 may be disposed on an area of the covering layer 28, which corresponds to the plate hole 210. The light transmission parts 281 may have a hole shape to pass through the covering layer 28. Thus, the light emitting member 74 may be configured so that light passes through the light transmission part 281.

The light transmission part 281 may have a fine and uniform circular shape. An area outside the light transmission part 281 may block the light emitted from the light emitting member 74 to prevent the light from being transmitted.

When the light emitting member 74 disposed at a position corresponding to the plate hole 210 is turned on, light emitted from the light emitting member 74 may sequentially pass through the light transmission part 281 of the covering layer 28, the hole filling member 23, and the coating layer 22 and then be emitted to the outside.

Thus, the display part 11 may be shined in the form of a figure, character, or symbol by the light transmission part 281 disposed in the inner region of the plate hole 210 corresponding to the plurality of light emitting members 74, which are turned on, when viewed from the outside, thereby transmitting information to a user.

Figure 18:
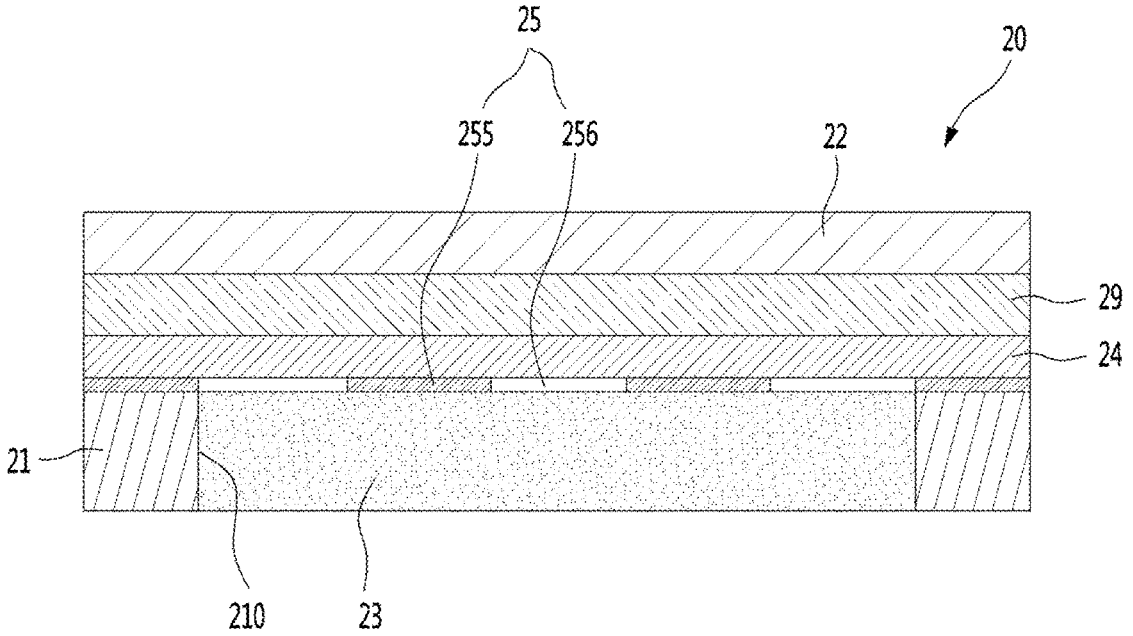
FIG. 18 is a cross-sectional view illustrating an example display part according to an eighth implementation.

FIG. 18 is a cross-sectional view illustrating an example display part according to an eighth implementation.

As illustrated in FIG. 18, an out plate 20 according to an eighth implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 210 may be defined in the steel plate 21.

In some implementations, a covering layer 24 may be disposed on a front surface of the steel plate 21, i.e., the top surface. A printed layer 25 may be disposed on a bottom surface of the covering layer 24. The printed layer 25 may include a light blocking part 255 and a light transmission part 256.

That is, the light blocking part 255 and the light transmission part 256 may be provided on a surface of the covering layer 24 through printing. The light transmission part 256 may have a fine and uniform circular shape. A plurality of the light transmission parts 256 may be disposed in an inner region of the plate hole 210 to allow light emitted from the light emitting member 74 to pass therethrough. An area outside the light transmission part 256 may block the light emitted from the light emitting member 74 to prevent the light from being transmitted to the light blocking part 255.

The covering layer 24 may be attached to the steel plate 21 in a state in which a top surface of the covering layer 24, on which the light blocking part 255 and the light transmission part 256 are disposed, contacts top surfaces of the steel plate 21 and the hole filling member 23. That is, a film type covering layer 24 on which the light blocking part 255 and the light transmission part 256 are printed may be attached to the front surface of the steel plate 21.

In some implementations, a deposition layer 29 may be disposed on a top surface of the covering layer 24. The deposition layer may be configured so that the area of the plate hole 210 is completely covered and has the same texture as the metal in the state in which the light emitting member 74 is turned off.

The deposition layer may be provided in a very thin metal layer by metal deposition. Thus, when the light emitting member 74 is turned off, the area of the plate hole 210 may be completely covered. On the other hand, when the light emitting member 74 is turned on, light may be transmitted so that the light transmission part 256 is seen to be shining.

When the deposition layer 29 is not made of the metal material, and the light emitting member 74 is not seen further in the state in which the light emitting member 74 is turned off. When the light emitting member 74 is turned on, the deposition layer 29 may have a different shape so that the light transmission part 256 is seen to be shining. Thus, the deposition layer 29 may be called a hole cover part.

In some implementations, a coating layer 22 may be disposed on a front surface of the deposition layer 29, i.e., the top surface. The coating layer 22 may define an outer appearance of the front surface of the out plate 20. The front surface of the out plate 20 may have a texture and a color of an outer appearance thereof by the coating layer 22.

A hole filling member 23 may be disposed in the plate hole 210. The hole filling member 23 may be made of a light transmitting material and may be cured in the state in which the plate hole 210 is completely filled.

When the light emitting member 74 disposed at a position corresponding to the plate hole 210 is turned on, light emitted from the light emitting member 74 may sequentially pass through the hole filling member 23, the covering layer 24, the light transmission part 256, the deposition layer 29, and the coating layer and then be emitted to the outside.

Thus, the display part 11 may be shined in the form of a figure, character, or symbol by the light transmission part 256 disposed in the inner region of the plate hole 210 corresponding to the plurality of light emitting members 74, which are turned on, when viewed from the outside, thereby transmitting information to a user.

Figure 19:
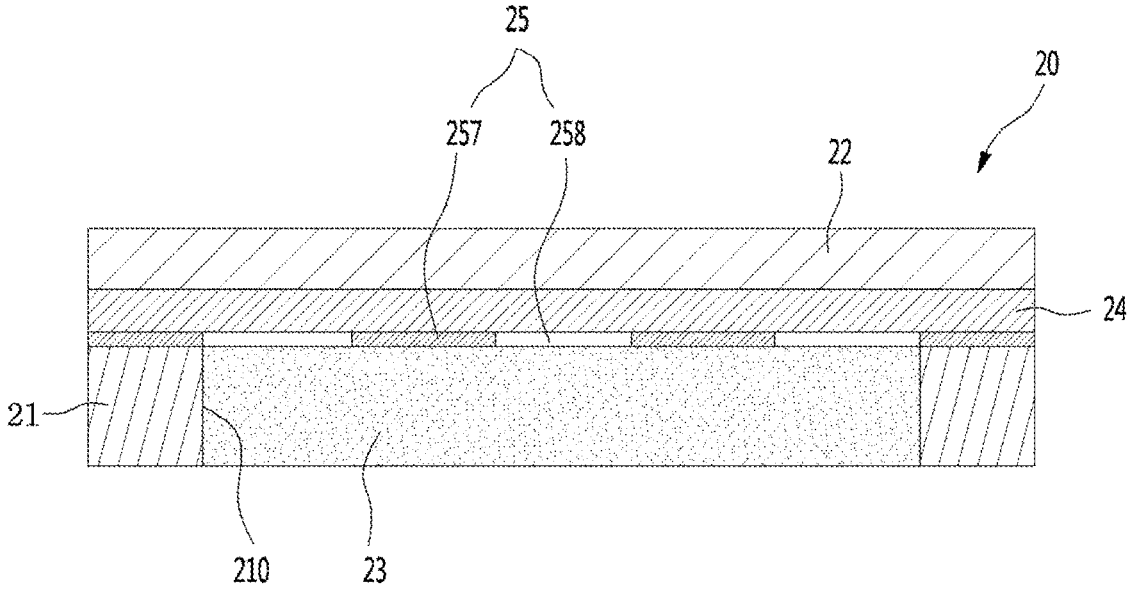
FIG. 19 is a cross-sectional view illustrating an example display part according to a ninth implementation.

FIG. 19 is a cross-sectional view illustrating an example display part according to a ninth implementation.

As illustrated in FIG. 19, an out plate 20 according to a ninth implementation defines a front surface of a door 10, and a display part 11 for displaying an operation state of a refrigerator 1 is disposed on the door 10.

Referring to a cross-section of an area on which the display part 11 is disposed, the out plate 20 may include a steel plate made of a metal material, and a plate hole 210 may be defined in the steel plate 21.

In some implementations, a covering layer 24 may be disposed on a front surface of the steel plate 21, i.e., the top surface. A printed layer 25 may be disposed on a bottom surface of the covering layer 24. The printed layer 25 may include a light blocking part 257 and a light transmission part 258.

That is, the light blocking part 257 and the light transmission part 258 may be provided on a surface of the covering layer 24 through printing. The light transmission part 258 may have a fine and uniform circular shape. A plurality of the light transmission parts 258 may be disposed in an inner region of the plate hole 210 to allow light emitted from the light emitting member 74 to pass therethrough. An area outside the light transmission part 258 may block the light emitted from the light emitting member 74 to prevent the light from being transmitted to the light blocking part 257.

The covering layer 24 may be attached to the steel plate 21 in a state in which a top surface of the covering layer 24, on which the light blocking part 257 and the light transmission part 258 are disposed, contacts top surfaces of the steel plate 21 and the hole filling member 23. That is, a film type covering layer 24 on which the light blocking part 257 and the light transmission part 258 are printed may be attached to the front surface of the steel plate 21.

In some implementations, a coating layer 22 may be disposed on a front surface of the covering layer 24, i.e., the top surface. The coating layer 22 may define an outer appearance of the front surface of the out plate 20. The front surface of the out plate 20 may have a texture and a color of an outer appearance thereof by the coating layer 22.

A hole filling member 23 may be disposed in the plate hole 210. The hole filling member 23 may be made of a light transmitting material and may be cured in the state in which the plate hole 210 is completely filled.

When the light emitting member 74 disposed at a position corresponding to the plate hole 210 is turned on, light emitted from the light emitting member 74 may sequentially pass through the hole filling member 23, the covering layer 24, the light transmission part 258, and the coating layer and then be emitted to the outside.

Thus, the display part 11 may be shined in the form of a figure, character, or symbol by the light transmission part 258 disposed in the inner region of the plate hole 210 corresponding to the plurality of light emitting members 74, which are turned on, when viewed from the outside, thereby transmitting information to a user.

The refrigerator and the out plate for the refrigerator door may have the following effects.

In this implementation, the covering layer, in which the light transmission part having the fine hole shape is defined, may be substantially provided inside the plate hole having the large size without processing the fine hole in the out plate made of the metal material to realize the phenomenon in which the fine hole shape emits light to visualize the information of the refrigerator through the display part.

Thus, since it is unnecessary to repeatedly perform the etching process for processing the fine hole in the out plate, the manufacturing cost and the productivity may be significantly improved.

In some implementations, since the out plate is attached in the state in which the light transmission parts having the size of the several hundred micrometers is defined in the covering layer, the light transmission parts that emit light through the display part may have the uniform size. Thus, the defective incidence rate may be remarkably lowered, and the appearance quality and the information recognition performance may be improved in the operation of the display part.

Particularly, the light transmission part may be formed on the covering layer in the printing manner to improve the workability and the productivity as well as precisely forming the light transmission part having the fine size.

In some implementations, the hole filling member may be disposed in the plate hole so that the boundary of the plate hole is not visible when the light emitting member is turned off. In addition, the light transmission part and the light blocking part may be prevented from being exposed to the outside to improve the outer appearance of the door in the state in which the light emitting member is turned off, and the light emitting portion and the non-emission portion may be clearly distinguished from each other.

In some implementations, the coating layer may be formed on the surface of the out plate to realize the surface property, color, or texture of the refrigerator door, and also, in the state in which the light emitting member is turned off, the plate hole and the light transmission part may be more concealed.

In addition, the reinforcement layer made of a resin material may be further formed on the out plate. Thus, the deformation of the out plate due to the formation of the through-hole and the user's touch manipulation may be prevented by the reinforcement layer.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage space;

a door configured to open and close at least a portion of the storage space;

an out plate that is made of a metal material and that defines a front surface of the door;

a display part located at the out plate and configured to display operation information of the refrigerator by transmission of light, the display part defining a plurality of plate holes that pass through the out plate;

a plurality of light emitting members located in the door and configured to emit light at positions corresponding to the plurality of plate holes;

a plurality of hole filling members that fill the plurality of plate holes, the plurality of hole filling members being made of a material configured to transmit light; and a first layer located at a surface of the plurality of hole filling members, the first layer comprising:

a light blocking part configured to block light, and a plurality of light transmission parts positioned in an inner region of the plurality of plate holes and configured to transmit light, wherein the display part is configured to transmit light that has been emitted from one or more of the plurality of light emitting members and that has passed through one or more of the plurality of light transmission parts corresponding to the one or more of the plurality of light emitting members.

2. The refrigerator according to claim 1, wherein the display part is further configured to display a figure, a character, or a pattern based on transmission of light through one or more of the plurality of plate holes.

3. The refrigerator according to claim 1, wherein the plurality of plate holes define one or more multi-segment displays, each multi-segment display comprising a plurality of segments that are configured to indicate a figure, a character, a pattern, or a number.

4. The refrigerator according to claim 1, wherein the plurality of light transmission parts are arranged at each of the plurality of plate holes along a plane, and wherein a length of each of the plurality of light transmission parts along the plane is less than an opening size of each of the plurality of plate holes at the plane.

5. The refrigerator according to claim 1, further comprising a touch sensor assembly that is located at the door at a position spaced apart from the display part, that contacts the out plate, and that is configured to detect touch manipulation at the out plate.

6. An out plate for a refrigerator door, comprising:

a steel plate made of a metal, the steel plate defining a plurality of plate holes that pass through the steel plate and that are configured to display a figure, a character, or a pattern that relates to operation information of a refrigerator;

a plurality of hole filling members that fill the plurality of plate holes, the plurality of hole filling members being made of a material configured to transmit light;

a first layer located at a surface of the plurality of hole filling members, the first layer comprising:

a light blocking part configured to block light; and a plurality of light transmission parts positioned in an inner region of the plurality of plate holes and configured to transmit light emitted from a plurality of light emitting members, wherein the plurality of plate holes are configured to display the figure, the character, or the pattern by transmitting light that has been emitted from one or more of the plurality of light emitting members located at positions corresponding to the plurality of plate holes and that has passed through one or more of the plurality of light transmission parts.

7. The out plate according to claim 6, wherein a size of each of the plurality of light transmission parts is greater than or equal to 100 micrometers and less than 1 millimeter.

8. The out plate according to claim 6, wherein the steel plate comprises a stainless steel plate or a vinyl coated material (VCM) steel plate.

9. The out plate according to claim 6, further comprising a second layer that is located at a front surface of the steel plate, that is configured to transmit light, and that provides a color of the refrigerator door or a texture of the refrigerator door.

10. The out plate according to claim 9, further comprising a third layer located between the second layer and the steel plate and configured to provide a metal texture of the refrigerator door.

11. The out plate according to claim 9, further comprising a fourth layer located between the second layer and the steel plate and configured to structurally reinforce a strength of at least a portion of the steel plate, the fourth layer being made of a material configured to transmit light.

12. The out plate according to claim 9, wherein the first layer is located between the second layer and the steel plate.

13. The out plate according to claim 6, wherein the plurality of plate holes are defined by etching, and wherein the light blocking part is printed on a surface of the first layer at an area outside of the plurality of light transmission parts.

14. The out plate according to claim 13, further comprising an attachment guide part defined at the steel plate and configured to guide alignment of the plurality of light transmission parts to the plurality of plate holes based on the first layer being attached to the steel plate.

15. The out plate according to claim 6, wherein an inner side surface of each of the plurality of plate holes has an inclined shape or a round shape.

16. The out plate according to claim 6, further comprising a back coating layer located at a rear surface of the steel plate and configured to reduce corrosion of the steel plate and a chemical damage of the steel plate.

17. The out plate according to claim 6, wherein the first layer is made of a polyethylene terephthalate (PET) film material, wherein the light blocking part and the plurality of light transmission parts are manufactured by a printing process, and wherein the first layer is attached to the steel plate based on the first layer including the light blocking part and the plurality of light transmission parts manufactured by the printing process.

18. The out plate according to claim 17, wherein the first layer is located at a front surface of the steel plate.

19. The out plate according to claim 17, wherein the light blocking part and the plurality of light transmission parts are located at a surface of the first layer that contacts the plurality of hole filling members.

20. The out plate according to claim 6, wherein the first layer is made of a material configured to block light and located at a rear surface of the steel plate, and wherein each of the plurality of light transmission parts has a hole shape that passes through the first layer.

* * * * *